US011511289B2

(12) United States Patent
Geerligs et al.

(10) Patent No.: US 11,511,289 B2
(45) Date of Patent: Nov. 29, 2022

(54) ROTARY FULL CIRCLE NOZZLES AND DEFLECTORS

(71) Applicant: Rain Bird Corporation, Azusa, CA (US)

(72) Inventors: Steven David Geerligs, Tucson, AZ (US); Lee James Shadbolt, Tucson, AZ (US); Samuel C. Walker, Green Valley, AZ (US)

(73) Assignee: Rain Bird Corporation, Azusa, CA (US)

( * ) Notice: Subject to any disclaimer, the term of this patent is extended or adjusted under 35 U.S.C. 154(b) by 184 days.

(21) Appl. No.: 15/649,072

(22) Filed: Jul. 13, 2017

(65) Prior Publication Data

US 2019/0015849 A1 Jan. 17, 2019

(51) Int. Cl.
*B05B 1/26* (2006.01)
*B05B 1/30* (2006.01)
(Continued)

(52) U.S. Cl.
CPC ..... *B05B 1/265* (2013.01); *B05B 1/304* (2013.01); *B05B 1/3033* (2013.01); *B05B 3/003* (2013.01);
(Continued)

(58) Field of Classification Search
CPC ..... B05B 1/265; B05B 1/3033; B05B 1/262; B05B 3/0486; B05B 3/021; B05B 15/74; B05B 1/304; B05B 3/003; B05B 1/26
See application file for complete search history.

(56) References Cited

U.S. PATENT DOCUMENTS 581,252 A 4/1897 Quayle
598,873 A * 2/1898 Joy ..... B05B 1/265 239/498
(Continued)

FOREIGN PATENT DOCUMENTS

DE 19925279 12/1999
FR 2730901 9/1997
(Continued)

OTHER PUBLICATIONS

USPTO; U.S. Appl. No. 16/219,595; Office Action dated Mar. 15, 2021; (pp. 1-15).
(Continued)

*Primary Examiner* — Christopher R Dandridge
(74) *Attorney, Agent, or Firm* — Fitch, Even, Tabin & Flannery, LLP

(57) ABSTRACT

Irrigation nozzles are provided that irrigate a full circle coverage area with different maximum throw radiuses. The nozzle may include two bodies, one nested within the other, that acting together form the full circle coverage area. The two bodies collectively define an annular exit orifice with one of the bodies defining the inner radius and the other body defining the outer radius. A flow restrictable inlet may be used to adjust flow through the nozzle and to adjust the maximum throw radius. The nozzle may also include a flow reduction valve to reduce the throw radius from a maximum distance and may be adjusted by actuation of an outer wall of the nozzle. A deflector for use with an irrigation nozzle is also provided.

25 Claims, 38 Drawing Sheets

(51) Int. Cl.

| | |
|---|---|
| ***B05B 3/04*** | (2006.01) |
| ***B05B 3/00*** | (2006.01) |
| ***B05B 3/02*** | (2006.01) |
| *B05B 15/74* | (2018.01) |

(52) U.S. Cl.

CPC ..... *B05B 3/021* (2013.01); *B05B 3/0486* (2013.01); *B05B 15/74* (2018.02)

(56) References Cited

U.S. PATENT DOCUMENTS

| | | | |
|---|---|---|---|
| 1,286,333 | A | 12/1918 | Johnson |
| 3,030,032 | A | 4/1962 | Juhman, Jr. |
| 4,099,675 | A | 7/1978 | Wohler |
| 4,235,379 | A | 11/1980 | Beamer |
| 4,261,515 | A | 4/1981 | Rosenberg |
| 4,471,908 | A | 9/1984 | Hunter |
| 4,512,519 | A | 4/1985 | Uzrad |
| 4,632,312 | A | 12/1986 | Premo |
| 4,681,263 | A | 7/1987 | Cockman |
| 4,711,399 | A | 12/1987 | Rosenberg |
| 4,728,040 | A | 3/1988 | Healy |
| 4,754,925 | A | 7/1988 | Rubinstein |
| 4,760,958 | A | 8/1988 | Greenberg |
| 4,783,004 | A | 11/1988 | Lockwood |
| 4,796,811 | A | 1/1989 | Davisson |
| 4,815,662 | A | 3/1989 | Hunter |
| 4,817,869 | A | 4/1989 | Rubinstein |
| 4,832,264 | A | 5/1989 | Rosenberg |
| 4,842,201 | A | 6/1989 | Hunter |
| 4,867,379 | A | 9/1989 | Hunter |
| 4,898,332 | A | 2/1990 | Hunter |
| 4,932,590 | A | 6/1990 | Hunter |
| 4,944,456 | A | 7/1990 | Zakai |
| 4,957,240 | A | 9/1990 | Rosenberg |
| 4,961,534 | A | 10/1990 | Tyler |
| 4,967,961 | A | 11/1990 | Hunter |
| 5,031,840 | A | 7/1991 | Grundy |
| 5,050,800 | A | 9/1991 | Lamar |
| 5,058,806 | A | 10/1991 | Rupar |
| 5,152,458 | A | 10/1992 | Curtis |
| 5,158,232 | A | 10/1992 | Tyler |
| 5,205,491 | A | 4/1993 | Hadar |
| 5,226,602 | A | 7/1993 | Cochran |
| 5,288,022 | A | 2/1994 | Sesser |
| 5,360,167 | A | 11/1994 | Grundy |
| 5,381,960 | A | 1/1995 | Sullivan |
| 5,415,348 | A | 5/1995 | Nelson |
| 5,439,174 | A | 8/1995 | Sweet |
| 5,456,411 | A | 10/1995 | Scott |
| 5,588,595 | A | 12/1996 | Sweet |
| 5,669,449 | A | 9/1997 | Polan |
| 5,671,886 | A | 9/1997 | Sesser |
| 5,699,962 | A | 12/1997 | Scott |
| 5,718,381 | A | 2/1998 | Katzer |
| 5,762,269 | A | 6/1998 | Sweet |
| 6,059,044 | A | 5/2000 | Fischer |
| 6,085,995 | A | 7/2000 | Kah |
| 6,092,739 | A | 7/2000 | Clearman |
| 6,123,272 | A | 9/2000 | Havican |
| 6,234,411 | B1 | 5/2001 | Walker |
| 6,254,013 | B1 | 7/2001 | Clearman |
| 6,267,299 | B1 | 7/2001 | Meyer |
| 6,276,460 | B1 | 8/2001 | Pahila |
| 6,341,733 | B1 | 1/2002 | Sweet |
| 6,435,427 | B1 | 8/2002 | Conroy |
| 6,439,477 | B1 | 8/2002 | Sweet |
| 6,481,644 | B1 | 11/2002 | Olsen |
| 6,516,893 | B2 | 2/2003 | Pahila |
| 6,651,904 | B2 | 11/2003 | Roman |
| 6,651,905 | B2 | 11/2003 | Sesser |
| 6,688,539 | B2 | 2/2004 | Vander Griend |
| 6,736,332 | B2 | 5/2004 | Sesser |
| 6,811,098 | B2 | 11/2004 | Drechsel |
| 6,814,304 | B2 | 11/2004 | Onofrio |
| 6,834,816 | B2 | 12/2004 | Kah, Jr. |
| 6,883,727 | B2 | 4/2005 | De Los Santos |
| 6,942,164 | B2 | 9/2005 | Walker |
| 6,976,543 | B1 | 12/2005 | Fischer |
| 7,032,836 | B2 | 4/2006 | Sesser |
| 7,100,842 | B2 | 9/2006 | Meyer |
| 7,143,957 | B2 | 12/2006 | Nelson |
| 7,143,962 | B2 | 12/2006 | Kah, Jr. |
| 7,156,322 | B1 | 1/2007 | Heitzman |
| 7,159,795 | B2 | 1/2007 | Sesser |
| 7,168,634 | B2 | 1/2007 | Onofrio |
| 7,232,081 | B2 | 6/2007 | Kah |
| 7,240,860 | B2 | 7/2007 | Griend |
| 7,395,977 | B2 | 7/2008 | Pinch |
| 7,584,904 | B2 | 9/2009 | Townsend |
| 7,597,273 | B2 | 10/2009 | McAfee |
| 7,597,276 | B2 | 10/2009 | Hawkins |
| 7,611,077 | B2 | 11/2009 | Sesser |
| 7,624,935 | B2 | 12/2009 | Nelson |
| 7,703,706 | B2 | 4/2010 | Walker |
| D615,152 | S | 5/2010 | Kah |
| 7,717,361 | B2 | 5/2010 | Nelson |
| 7,789,323 | B2 | 9/2010 | Nelson |
| D628,272 | S | 11/2010 | Kah |
| D636,459 | S | 4/2011 | Kah |
| 7,942,345 | B2 | 5/2011 | Sesser |
| 7,954,731 | B2 | 6/2011 | Antonucci |
| 7,980,488 | B2 | 7/2011 | Townsend |
| 7,988,071 | B2 | 8/2011 | Bredberg |
| 8,006,919 | B2 | 8/2011 | Renquist |
| 8,028,932 | B2 | 10/2011 | Sesser |
| 8,047,456 | B2 | 11/2011 | Kah |
| 8,074,897 | B2 | 12/2011 | Hunnicutt |
| 8,272,578 | B1 | 9/2012 | Clark |
| 8,272,583 | B2 | 9/2012 | Hunnicutt |
| 8,282,022 | B2 | 10/2012 | Porter |
| 8,328,117 | B2 | 12/2012 | Bredberg |
| 8,540,171 | B2 | 9/2013 | Renquist |
| 8,567,691 | B2 | 10/2013 | Townsend |
| 8,567,697 | B2 | 10/2013 | Bredberg |
| 8,567,699 | B2 | 10/2013 | Sesser |
| 8,602,325 | B2 | 12/2013 | Clark |
| 8,672,242 | B2 | 3/2014 | Hunnicutt |
| 8,695,900 | B2 | 4/2014 | Hunnicutt |
| 8,783,582 | B2 | 7/2014 | Robertson |
| 8,789,768 | B2 | 7/2014 | Hunnicutt |
| 8,893,986 | B2 | 11/2014 | Kah, Jr. |
| 8,925,837 | B2 | 1/2015 | Walker |
| 8,991,724 | B2 | 3/2015 | Sesser |
| 8,991,726 | B2 | 3/2015 | Kah, Jr. |
| 8,991,730 | B2 | 3/2015 | Kah, Jr. |
| 9,079,202 | B2 | 7/2015 | Walker |
| 9,174,227 | B2 | 11/2015 | Robertson |
| 9,248,459 | B2 | 2/2016 | Kah, Jr. |
| 9,295,998 | B2 | 3/2016 | Shadbolt |
| 9,314,952 | B2 | 4/2016 | Walker |
| 9,327,297 | B2 | 5/2016 | Walker |
| 9,387,496 | B2 | 7/2016 | Kah, III |
| 9,427,751 | B2 | 8/2016 | Kim |
| 9,492,832 | B2 | 11/2016 | Kim |
| 9,504,209 | B2 | 11/2016 | Kim |
| 9,555,422 | B2 | 1/2017 | Zhao |
| 9,757,743 | B2 | 9/2017 | Kah, Jr. |
| 9,776,195 | B2 | 10/2017 | Russell |
| 9,808,813 | B1 | 11/2017 | Porter |
| 9,937,513 | B2 | 4/2018 | Kah, III |
| 9,981,276 | B2 | 5/2018 | Kah, Jr. |
| 9,987,639 | B2 | 6/2018 | Russell |
| 10,092,913 | B2 | 10/2018 | Gopalan |
| 10,201,818 | B2 | 2/2019 | Duffin |
| 10,213,802 | B2 | 2/2019 | Kah, Jr. |
| 10,232,388 | B2 | 3/2019 | Glezerman |
| 10,232,389 | B1 | 3/2019 | Forrest |
| 10,239,067 | B2 | 3/2019 | Glezerman |
| 10,322,422 | B2 | 6/2019 | Simmons |
| 10,322,423 | B2 | 6/2019 | Walker |
| 2002/0139868 | A1 | 10/2002 | Sesser |
| 2003/0075620 | A1 | 4/2003 | Kah, Jr. |
| 2008/0054093 | A1 | 3/2008 | Nelson |

(56) References Cited

U.S. PATENT DOCUMENTS

| | | | | |
|---|---|---|---|---|
| 2008/0087743 | A1 | 4/2008 | Govrin | |
| 2008/0257982 | A1 | 10/2008 | Kah | |
| 2009/0078788 | A1 | 3/2009 | Holmes | |
| 2009/0108099 | A1* | 4/2009 | Porter | B05B 3/0422 239/222.11 |
| 2010/0078508 | A1 | 4/2010 | South | |
| 2010/0090024 | A1 | 4/2010 | Hunnicutt | |
| 2010/0301135 | A1* | 12/2010 | Hunnicutt | B05B 3/021 239/443 |
| 2011/0031325 | A1 | 2/2011 | Perkins | |
| 2011/0031332 | A1 | 2/2011 | Sesser | |
| 2012/0273592 | A1 | 11/2012 | Zhang | |
| 2012/0292403 | A1 | 11/2012 | Hunnicutt | |
| 2013/0105596 | A1 | 5/2013 | Kah, III | |
| 2014/0027527 | A1* | 1/2014 | Walker | B05B 3/021 239/499 |
| 2014/0042251 | A1 | 2/2014 | Maksymec | |
| 2014/0110501 | A1 | 4/2014 | Lawyer | |
| 2014/0224900 | A1 | 8/2014 | Kim | |
| 2014/0263735 | A1 | 9/2014 | Nations | |
| 2014/0339334 | A1 | 11/2014 | Kah | |
| 2015/0076253 | A1 | 3/2015 | Kah, Jr. | |
| 2015/0083828 | A1 | 3/2015 | Maksymec | |
| 2015/0158036 | A1 | 6/2015 | Kah, Jr. | |
| 2015/0165455 | A1 | 6/2015 | Kah | |
| 2015/0321207 | A1 | 11/2015 | Kah | |
| 2017/0056899 | A1 | 3/2017 | Kim | |
| 2017/0128963 | A1 | 5/2017 | Liln | |
| 2017/0203311 | A1 | 7/2017 | Kim | |
| 2017/0348709 | A1 | 12/2017 | Kah, Jr. | |
| 2018/0015487 | A1 | 1/2018 | Russell | |
| 2018/0058684 | A1 | 3/2018 | Qiu | |
| 2018/0141060 | A1 | 5/2018 | Walker | |
| 2018/0221895 | A1 | 8/2018 | McCarty | |
| 2018/0250692 | A1 | 9/2018 | Kah, Jr. | |
| 2018/0257093 | A1 | 9/2018 | Glezerman | |
| 2018/0280994 | A1 | 10/2018 | Walker | |
| 2018/0311684 | A1 | 11/2018 | Lawyer | |
| 2019/0015849 | A1 | 1/2019 | Geerligs | |
| 2019/0054480 | A1 | 2/2019 | Sesser | |
| 2019/0054481 | A1 | 2/2019 | Sesser | |
| 2019/0118195 | A1 | 4/2019 | Geerligs | |
| 2019/0133059 | A1 | 5/2019 | DeWitt | |
| 2019/0143361 | A1 | 5/2019 | Kah, Jr. | |
| 2019/0193095 | A1 | 6/2019 | Sesser | |

FOREIGN PATENT DOCUMENTS

| | | |
|---|---|---|
| GB | 908314 | 10/1962 |
| IL | 35182 | 4/1973 |

OTHER PUBLICATIONS

USPTO; U.S. Appl. No. 16/243,580; Corrected Notice of Allowability dated Apr. 7, 2021; (pp. 1-2).

"Arcuate." Dictionary.com 2021. https://www.dictionary.com/browse/arcuate (Dec. 12, 2021). (Year: 2021).

USPTO; U.S. Appl. No. 16/219,595; Non-Final Rejection dated Dec. 16, 2021; (pp. 1-17).

Images of deflector of K-Rain Rotary Nozzle RN200-ADJ, publicly available before Jul. 13, 2017.

USPTO; U.S. Appl. No. 16/219,595; Non-Final Rejection dated Jun. 23, 2022; (pp. 1-14).

* cited by examiner

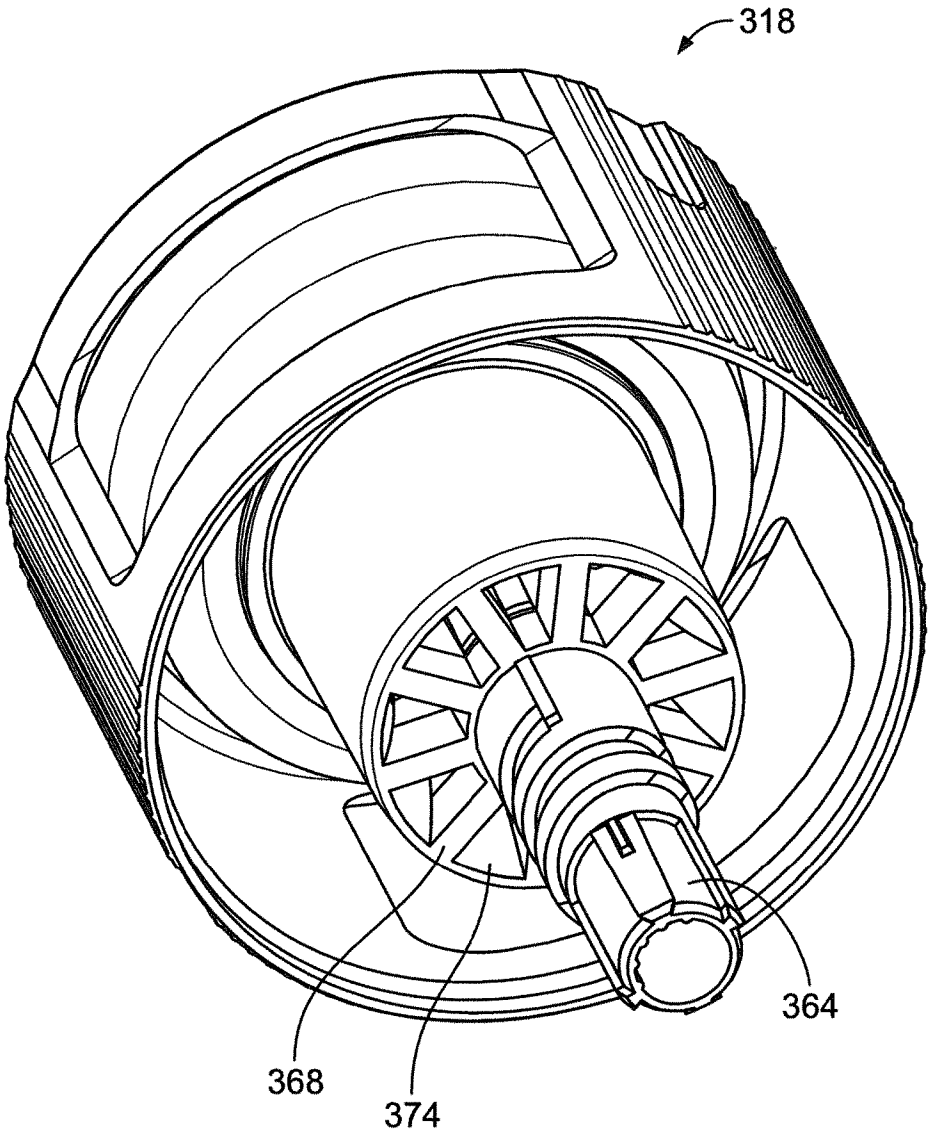
FIG. 18
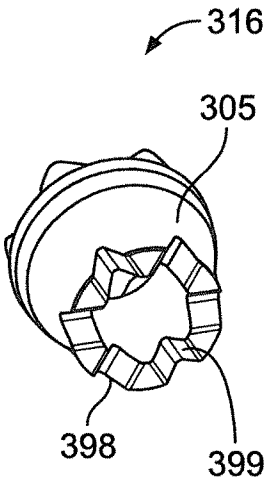

ROTARY FULL CIRCLE NOZZLES AND DEFLECTORS

FIELD

The invention relates to irrigation nozzles and deflectors and, more particularly, to a rotary nozzle for distribution of water in a full circle irrigation pattern.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotary nozzle or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, water is directed upwardly against a rotatable deflector having a vaned lower surface defining an array of relatively small flow channels extending upwardly and turning radially outwardly with a spiral component of direction. The water impinges upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the amount of water through the nozzle, among other things.

In some applications, it is desirable to be able to set either a rotating stream or a fixed spray nozzle for irrigating a 360 degree area of terrain about the nozzle. Some nozzles have been designed to provide an adjustable arc of coverage, but some of these adjustable arc nozzles may only provide coverage within a limited arcuate range. This arcuate range may not include 360 degree coverage. Also, many nozzles have relatively narrow flow passages that require a relatively fine filter to screen out grit and other debris or that may be susceptible to clogging.

It is also desirable to control or regulate the throw radius of the water distributed to the surrounding terrain. In this regard, in the absence of a radius adjustment device, the irrigation nozzle will have limited variability in the throw radius of water distributed from the nozzle. The inability to adjust the throw radius results both in the wasteful and insufficient watering of terrain. A radius adjustment device is desired to provide flexibility in water distribution through varying radius pattern, and without varying the water pressure from the source. Some designs provide only limited adjustability and, therefore, allow only a limited range over which water may be distributed by the nozzle.

Further, it is desirable to consider other components of irrigation nozzles that may be designed to increase the maximum throw radius of the irrigation nozzle, such as the rotating deflector. Many such rotating deflectors have curved vanes or flutes on their underside surface that are impacted and driven by fluid flowing through the nozzle and that are then distributed outwardly from the rotating deflector. It would be desirable to arrange these vanes/flutes in a manner that would allow the rotating deflector to be driven more efficiently and would achieve a greater throw radius.

Accordingly, a need exists for a nozzle that can provide full circle irrigation. In addition, a need exists to increase the adjustability of the throw radius of an irrigation nozzle without varying the water pressure. Further, a need exists to provide a type of rotatable deflector to increase or maximize the throw radius of irrigation nozzles.

BRIEF DESCRIPTION OF THE DRAWINGS

FIG. 18 is a bottom perspective view of the unassembled valve sleeve and nozzle housing of the nozzle of FIG. 15;

DESCRIPTION OF THE PREFERRED EMBODIMENTS

Figure 1:
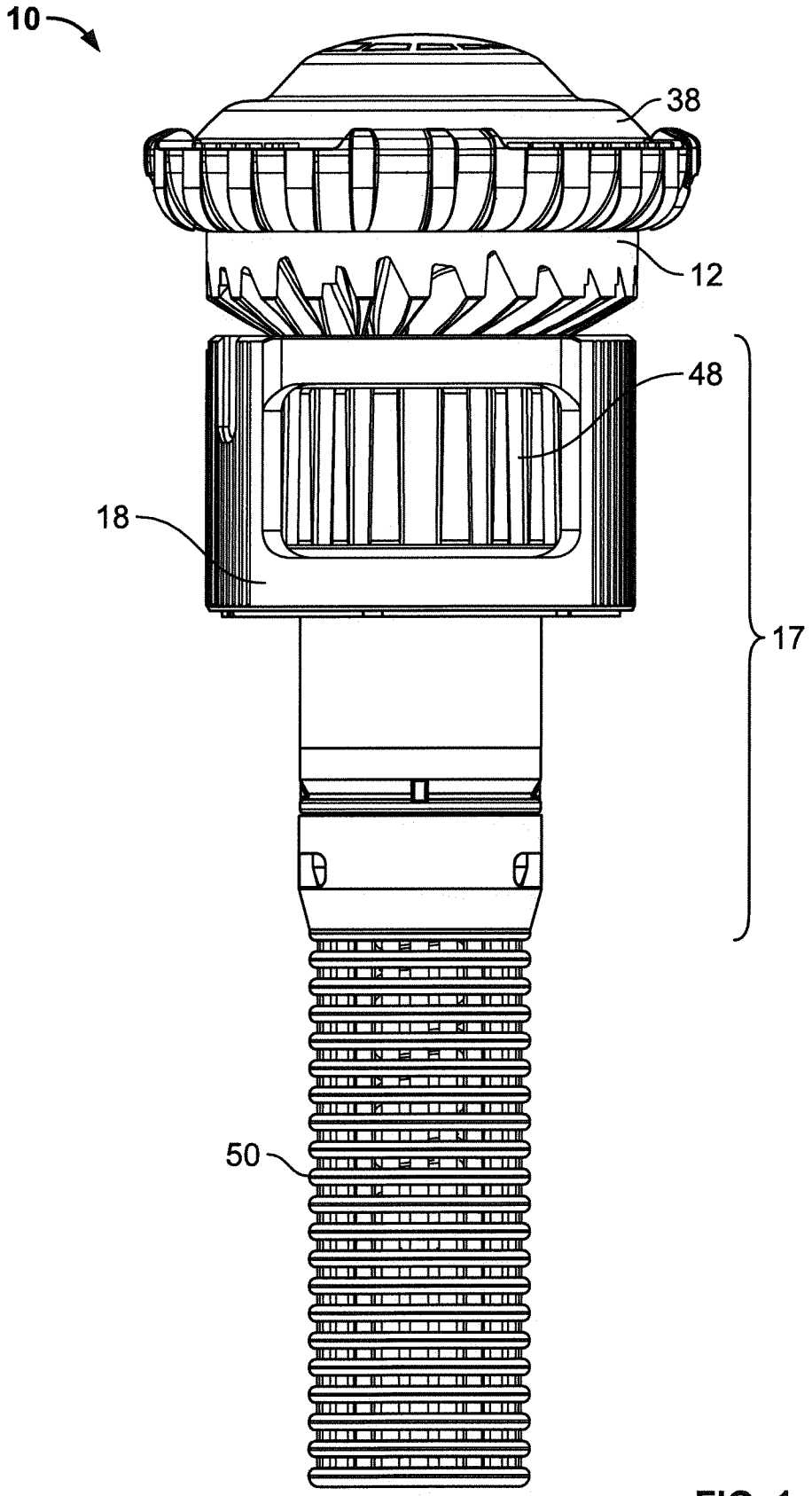
FIG. 1 is an elevation view of a first embodiment of a nozzle embodying features of the present invention.

FIGS. 1-9 show a first embodiment of a sprinkler head or nozzle 10 that produces 360 degrees of coverage, or full circle irrigation, about the nozzle 10. As addressed further below, there are several different embodiments of full circle nozzles that are intended for different maximum throw radiuses (preferably about 14 feet (4.27 meters), 18 feet (5.49 meters), and 24 feet (7.32 meters)). This disclosure describes five separate distinct models of nozzle that produce full circle irrigation patterns. The nozzle 10 also preferably includes a radius adjustment feature, which is shown in FIGS. 1-4B, to reduce the throw radius for each nozzle (preferably to about 8 feet (2.44 meters), 13 feet (3.96 meters), and 17 feet (5.18 meters), respectively). The radius adjustment feature is accessible by rotating an outer wall portion of the nozzle 10, as described further below. As should be understood, these maximum throw radiuses of these embodiments are just illustrative to show some of the differences between embodiments and are not intended as requirements. Other embodiments may produce different maximum throw radiuses pursuant to this disclosure.

Some of the structural components of the nozzle 10 are similar to those described in U.S. Pat. Nos. 9,295,998 and 9,327,297, which are assigned to the assignee of the present application and which patents are incorporated herein by reference in their entirety. Also, some of the user operation for radius adjustment is similar to that described in these two patents. Differences are addressed below and can be seen with reference to the figures.

As described in more detail below, the nozzle 10 includes a rotating deflector 12 and two bodies (a valve sleeve 16 and nozzle housing 18) that together define an annular exit orifice 15 (or annular discharge gap) therebetween to produce full circle irrigation. The deflector 12 is supported for rotation by a shaft 20, which itself does not rotate. Indeed, in certain preferred forms, the shaft 20 may be fixed against rotation, such as through use of splined engagement surface 72.

Figure 2:
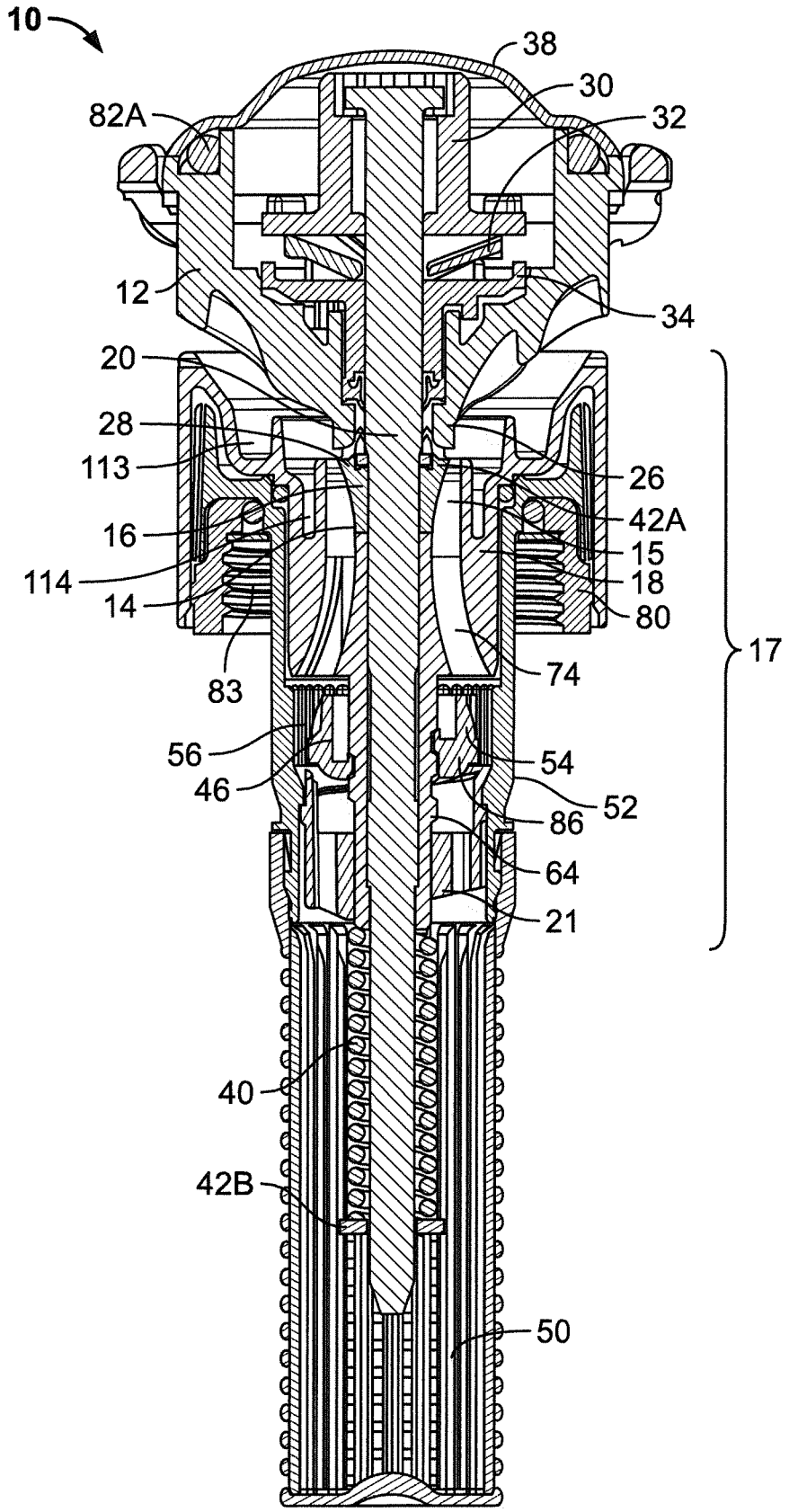
FIG. 2 is a cross-sectional view of the nozzle of FIG. 1.

As can be seen in FIGS. 1-4B, the nozzle 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 17. As can be seen in FIGS. 1 and 2, the nozzle body 17 generally refers to the sub-assembly of components disposed between the filter 50 and the deflector 12. The water preferably passes through an inlet 21 controlled by a radius adjustment feature that regulates the amount of fluid flow through the nozzle body 17. Water is then directed generally upwardly through flow passages in the nozzle housing 18 and through the annular exit orifice 15 to produce upwardly directed water jets that impinge the underside surface of the deflector 12 for rotatably driving the deflector 12.

Figure 4A:
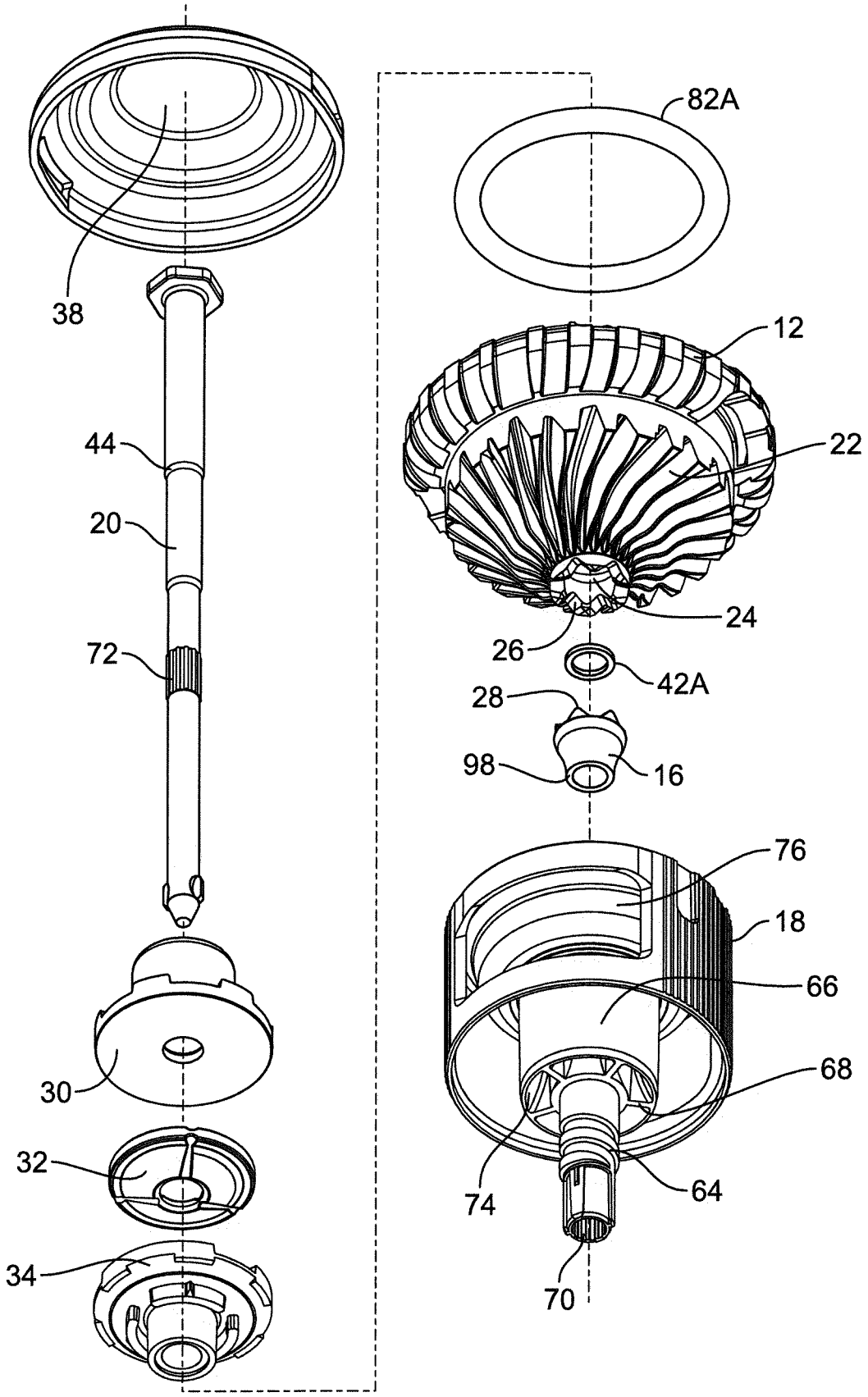
FIGS. 4A and 4B are bottom exploded perspective views of the nozzle of FIG. 1.

The rotatable deflector 12 has an underside surface that is preferably contoured to deliver a plurality of fluid streams generally radially outwardly. As shown in FIG. 4A, the underside surface of the deflector 12 preferably includes an array of spiral vanes 22. The spiral vanes 22 subdivide the water into the plurality of relatively small water streams which are distributed radially outwardly to surrounding terrain as the deflector 12 rotates. The vanes 22 define a plurality of intervening flow channels extending upwardly and spiraling along the underside surface to extend generally radially outwardly with predetermined inclination angles. During operation of the nozzle 10, the upwardly directed water impinges upon the lower or upstream segments of these vanes 22, which subdivide the water flow into the plurality of relatively small flow streams for passage through the flow channels and radially outward projection from the nozzle 10. The offset of the flow channels also enables the water to drive rotation of the deflector 12. Although any deflector suitable for distributing fluid radially outward from the nozzle 10 may be used, this disclosure also includes a specialized form of deflector that has been found to generally increase the maximum throw radius, and these specialized deflectors are described at the end of this disclosure.

The deflector 12 has a bore 24 for insertion of a shaft 20 therethrough. As can be seen in FIG. 4A, the bore 24 is defined at its lower end by circumferentially-arranged, downwardly-protruding teeth 26. As described further below, these teeth 26 are sized to engage corresponding teeth 28 on the valve sleeve 16. This engagement allows a user to depress the deflector 12, so that the deflector teeth 26 and valve sleeve teeth 28 engage, and then rotate the entire nozzle 10 to conveniently install the nozzle 10 on a retracted riser stem, as addressed further below.

The deflector 12 also preferably includes a speed control brake to control the rotational speed of the deflector 12. In one preferred form shown in FIGS. 2, 3A, and 4A, the speed control brake includes a friction disk 30, a brake pad 32, and a seal retainer 34. The friction disk 30 preferably has an internal surface (or socket) for engagement with a top surface (or head) on the shaft 20 so as to fix the friction disk 30 against rotation. The seal retainer 34 is preferably welded to, and rotatable with, the deflector 12 and, during operation of the nozzle 10, is urged against the brake pad 32, which, in turn, is retained against the friction disk 30. Water is directed upwardly and strikes the deflector 12, pushing the deflector 12 and seal retainer 34 upwards and causing rotation. In turn, the rotating seal retainer 34 engages the brake pad 32, resulting in frictional resistance that serves to reduce, or brake, the rotational speed of the deflector 12. Speed brakes like the type shown in U.S. Pat. No. 9,079,202 and U.S. patent application Ser. No. 15/359,286, which are assigned to the assignee of the present application and are incorporated herein by reference in their entirety, are preferably used. Although the speed control brake is shown and preferably used in connection with nozzle 10 described and claimed herein, other brakes or speed reducing mechanisms are available and may be used to control the rotational speed of the deflector 12.

The deflector 12 is supported for rotation by shaft 20. Shaft 20 extends along a central axis of the nozzle 10, and the deflector 12 is rotatably mounted on an upper end of the shaft 20. As can be seen from FIG. 2, the shaft 20 extends through the bore 24 in the deflector 12 and through aligned bores in the friction disk 30, brake pad 32, and seal retainer 34, respectively. A cap 38 and o-ring, 82A are mounted to the top of the deflector 12. The cap 38, in conjunction with the o-ring, 82A, prevent grit and other debris from coming into contact with the components in the interior of the deflector sub-assembly, such as the speed control brake components, and thereby hindering the operation of the nozzle 10.

The deflector 12, in conjunction with the seal retainer 34, brake pad 32 and friction disk 30, can be extended or pulled in an upward direction while the nozzle 10 is energized and distributing fluid. This upward movement displaces the valve sleeve 16 from the nozzle housing 18 in a vertical direction to temporarily increase the size of the annular discharge gap 15, and thus, allow for the clearance of trapped debris within the nozzle's internal passageways. This "pull to flush" feature allows for the flushing of trapped debris out in the direction of the fluid flow.

A spring 40 mounted to the shaft 20 energizes and tightens the engagement of the valve sleeve 16 and the nozzle housing 18. More specifically, the spring 40 operates on the shaft 20 to bias the first of the two nozzle body portions (valve sleeve 16) downwardly against the second portion (nozzle housing 18). Mounting the spring 40 at one end of the shaft 20 results in a lower cost of assembly. As can be seen in FIG. 2, the spring 40 is mounted near the lower end of the shaft 20 and downwardly biases the shaft 20. In turn, the shaft shoulder 44 exerts a downward force on the washer/retaining ring 42A and valve sleeve 16 for pressed fit engagement with the nozzle housing 18. The valve sleeve 16 and nozzle housing 18 are addressed in greater detail below.

As shown in FIG. 2, the nozzle 10 also preferably include a radius control valve 46. The radius control valve 46 can be used to adjust the fluid flowing through the nozzle 10 for purposes of regulating the range of throw of the projected water streams. It is adapted for variable setting through use of a rotatable segment 48 located on an outer wall portion of the nozzle 10. It functions as a valve that can be opened or closed to allow the flow of water through the nozzle 10. Also, a filter 50 is preferably located upstream of the radius control valve 46, so that it obstructs passage of sizable particulate and other debris that could otherwise damage the nozzle components or compromise desired efficacy of the nozzle 10. In one preferred form, a relatively large filter screen (relative to some filters used with other nozzles) may be used, such as, for example, a 0.02"×0.02" (0.5 mm×0.5 mm) filter screen. Although shown with the larger inlet filter screen, a variety of sized filters can be used with this design to prevent undesirable sized debris from entering the nozzle 10.

As shown in FIGS. 2-4B, the radius control valve structure preferably includes a nozzle collar 52 and a flow control member 54. The nozzle collar 52 is rotatable about the central axis of the nozzle 10. It has an internal engagement surface 56 and engages the flow control member 54 so that rotation of the nozzle collar 52 results in rotation of the flow control member 54. The flow control member 54 also engages the nozzle housing 18 such that rotation of the flow control member 54 causes the member 54 to also move in an axial direction, as described further below. In this manner, rotation of the nozzle collar 52 can be used to move the flow control member 54 helically in an axial direction closer to and further away from the inlet 21. When the flow control member 54 is moved closer to the inlet 21, the throw radius is reduced. The axial movement of the flow control member 54 towards the inlet 21 increasingly constricts the flow through the inlet 21 just downstream of the inlet 21. When the flow control member 54 is moved further away from the inlet 21, the throw radius is increased until the maximum radius position is achieved. This axial movement allows the user to adjust the effective throw radius of the nozzle 10 without disruption of the streams dispersed by the deflector 12. Both ends of travel are restricted through the use of a clutching mechanism, including radial tabs 62, that prevents excessive torque application or over-travel of the flow control member 54 when the flow control member 54 is in its most distant position, or maximum radius setting, from the inlet 21.

As shown in FIGS. 2-4B, the nozzle collar 52 is preferably cylindrical in shape and includes an engagement surface 56, preferably a splined surface, on the interior of the cylinder. The nozzle collar 52 preferably also includes an outer wall 58 having an external grooved surface for gripping and rotation by a user. Water flowing through the inlet 21 passes through the interior of the cylinder and through the remainder of the nozzle body 17 to the deflector 12. Rotation of the outer wall 58 causes rotation of the entire nozzle collar 52.

Figure 3A:
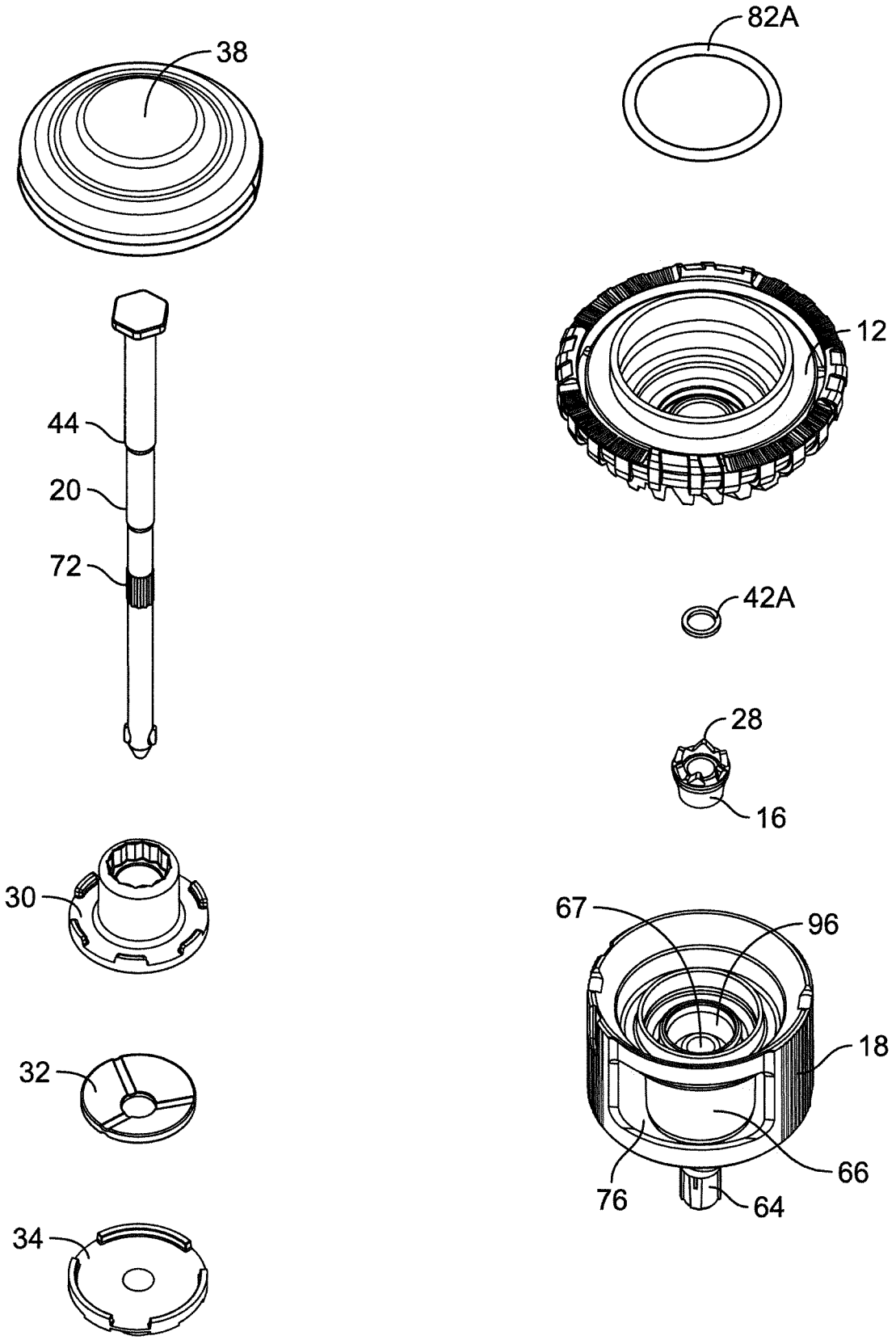
FIGS. 3A and 3B are top exploded perspective views of the nozzle of FIG. 1.
Figure 3B:
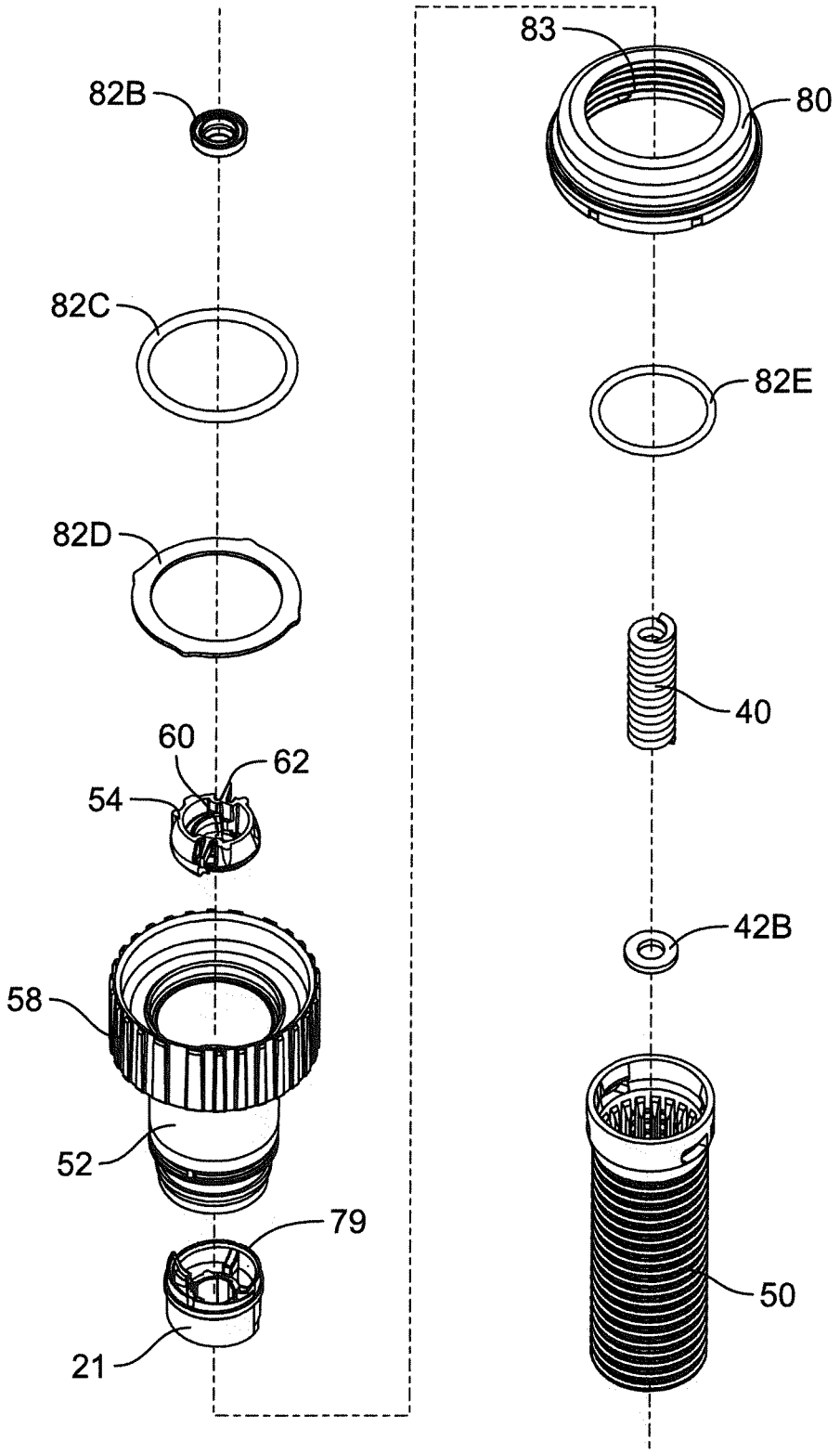
Figure 4B:
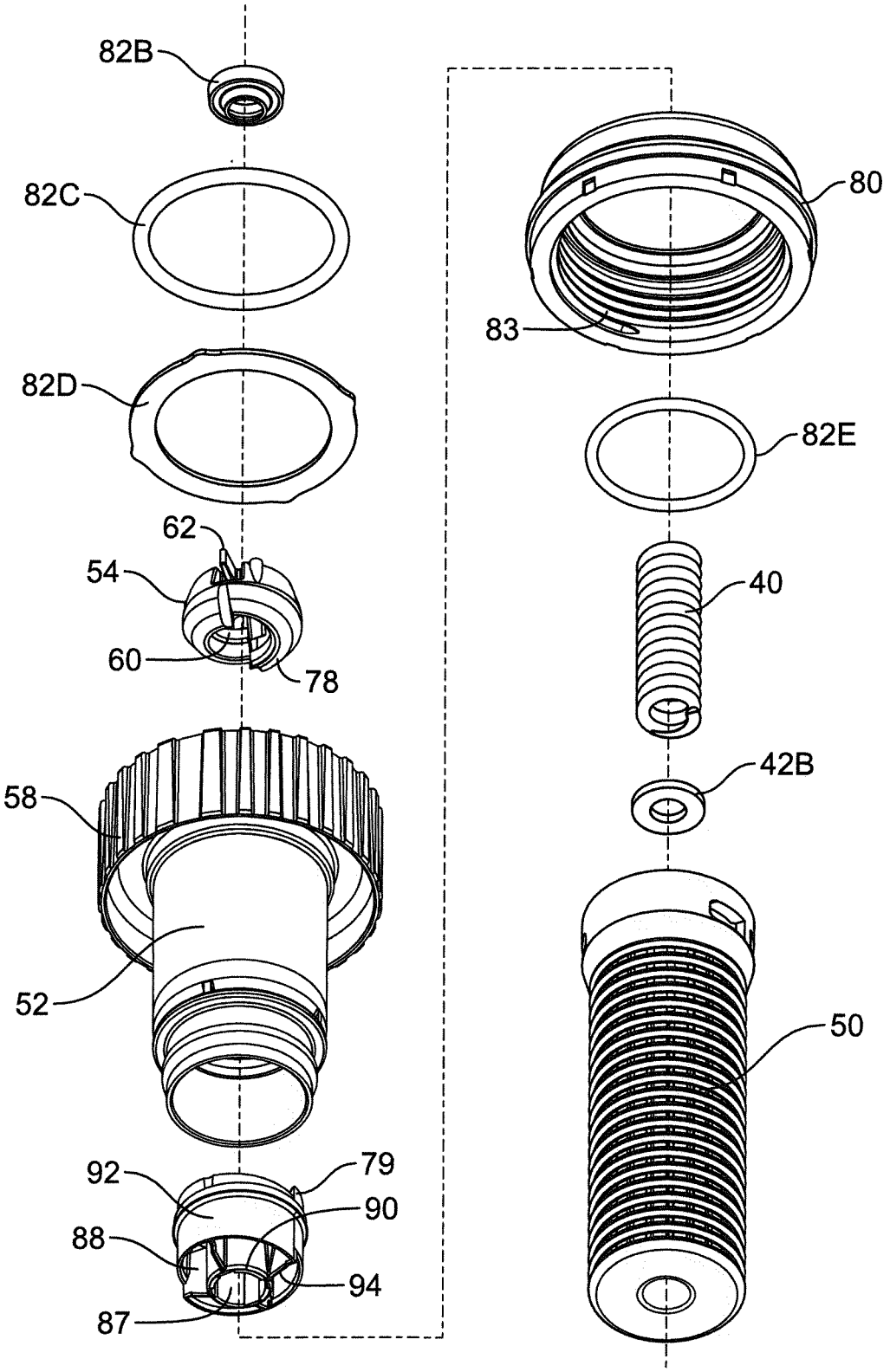

The nozzle collar 52 is coupled to the flow control member 54 (or throttle body). As shown in FIGS. 3B and 4B, the flow control member 54 is preferably in the form of a ring-shaped nut with a central hub defining a central bore 60. The flow control member 54 has an external surface with two thin tabs 62 extending radially outward for engagement with the corresponding internal splined surface 56 of the nozzle collar 52. The tabs 62 and internal splined surface 56 interlock such that rotation of the nozzle collar 52 causes rotation of the flow control member 54 about the central axis. In addition, these tabs 62 of the flow control member 54 act as a clutching mechanism that prevents over-travel and excessive application of torque, as well as providing a tactile and audible feedback to the user when the flow control member 54 reaches its respective limits of travel.

In turn, the flow control member 54 is coupled to the nozzle housing 18. More specifically, the flow control member 54 is internally threaded for engagement with an externally threaded hollow post 64 at the lower end of the nozzle housing 18. Rotation of the flow control member 54 causes it to move along the threading in an axial direction. In one preferred form, rotation of the flow control member 54 in a counterclockwise direction advances the member 54 towards the inlet 21 and away from the deflector 12. Conversely, rotation of the flow control member 54 in a clockwise direction causes the member 54 to move away from the inlet 21. Although specified here as counterclockwise for advancement toward the inlet 21 and clockwise for movement away from the inlet 21, this is not required, and either rotation direction could be assigned to the advancement and retreat of the flow control member 54 from the inlet 21. Finally, although threaded surfaces are shown in the preferred embodiment, it is contemplated that other engagement surfaces could be used to achieve an axial movement of the flow control member 54.

The nozzle housing 18 preferably includes an inner cylindrical wall 66 joined by spoke-like ribs 68 to a central hub 70. The central hub 70 preferably defines the bore 67 to accommodate insertion of the shaft 20 therein. The inside of the central hub 70 is preferably splined to engage a splined surface 72 of the shaft 20 and fix the shaft 20 against rotation. The lower end forms the external threaded hollow post 64 for insertion in the bore 60 of the flow control member 54, as discussed above. The spokes 68 define flow passages 74 to allow fluid flow upwardly through the remainder of the nozzle 10.

In operation, a user may rotate the outer wall 58 of the nozzle collar 52 in a clockwise or counterclockwise direction. As shown in FIGS. 3A and 4A, the nozzle housing 18 preferably includes one or more cut-out portions 76 to define one or more access windows to allow rotation of the nozzle collar outer wall 58. Further, as shown in FIG. 2, the nozzle collar 52, flow control member 54, and nozzle housing 18 are oriented and spaced to allow the flow control member 54 to essentially limit fluid flow through the nozzle 10 or to allow a desired amount of fluid flow through the nozzle 10. The flow control member 54 preferably has a radiused helical bottom surface 78 for engagement with a matching notched helical surface 79 on the inlet member. This matching helical surface 79 acts as a valve seat but with a segmented 360 degree pattern to allow a minimum flow when the matching helical surfaces 78 and 79 are fully engaged. The inlet 21 can be a separate insert component that snap fits and locks into the bottom of the nozzle collar 52. The inlet 21 also includes a bore 87 to receive the hollow post 64 of the nozzle housing 18. The bore 87 and the post 64 include complementary gripping surfaces so that the inlet 21 is locked against rotation.

Rotation in a counterclockwise direction results in helical movement of the flow control member 54 in an axial direction toward the inlet 21. Continued rotation results in the flow control member 54 advancing to the valve seat formed at the inlet 21 for restricting or significantly reducing fluid flow. The dimensions of the radial tabs 62 of the flow control member 54 and the splined internal surface 56 of the nozzle collar 52 are preferably selected to provide over-rotation protection. More specifically, the radial tabs 62 are sufficiently flexible such that they slip out of the splined recesses upon over-rotation, i.e., clutching. Once the limit of the travel of the flow control member 54 has been reached, further rotation of the nozzle collar 52 causes clutching of the radial tabs 62, allowing the collar 52 to continue to rotate without corresponding rotation of the flow control member 54, which might otherwise cause potential damage to the nozzle components.

Rotation in a clockwise direction causes the flow control member 54 to move axially away from the inlet 21. Continued rotation allows an increasing amount of fluid flow through the inlet 21, and the nozzle collar 52 may be rotated to the desired amount of fluid flow. It should be evident that the direction of rotation of the outer wall 58 for axial movement of the flow control member 54 can be easily reversed, i.e., from clockwise to counterclockwise or vice versa. When the valve is open, fluid flows through the nozzle 10 along the following flow path: through the inlet 21, between the nozzle collar 52 and the flow control member 54, through the passages 74 of the nozzle housing 18, through the constriction formed at the valve sleeve 16, to the underside surface of the deflector 12, and radially outwardly from the deflector 12.

The nozzle 10 also preferably includes a nozzle base 80 of generally cylindrical shape with internal threading 83 for quick and easy thread-on mounting onto a threaded upper end of a riser with complementary threading (not shown). The nozzle base 80 and nozzle housing 18 are preferably attached to one another by welding, snap-fit, or other fastening method such that the nozzle housing 18 is stationary relative to the base 80 when the base 80 is threadedly mounted to a riser. The nozzle 10 also preferably include seal members, such as seal members 82A, 82B, 82C, 82D, and 82E, at various positions, such as shown in FIGS. 2-4B, to reduce leakage. The nozzle 10 also preferably includes retaining rings or washers, such as retaining rings/washers 42A and 42B, disposed, for example, at the top of valve sleeve 16 (preferably for engagement with shaft shoulder 44) and near the bottom end of the shaft 20 for retaining the spring 40.

The radius adjustment valve 46 and certain other components described herein are preferably similar to that described in U.S. Pat. Nos. 8,272,583 and 8,925,837, which are assigned to the assignee of the present application and are incorporated herein by reference in their entirety. Generally, in this preferred form, the user rotates a nozzle collar 52 to cause the flow control member 54 (which may be in the form of a throttle nut) to move axially toward and away from the valve seat at the inlet 21 to adjust the throw radius. Although this type of radius adjustment valve 46 is described herein, it is contemplated that other types of radius adjustment valves may also be used.

The disclosure above generally describes some common components of the full circle nozzles. It is generally contemplated that these components or similar components may be used in the full circle nozzles described herein. As addressed further below, a few of the components (valve sleeve 16, nozzle housing 18, and inlet 21) are modified in the five embodiments to achieve different maximum throw radiuses.

As shown in FIGS. 2 and 5-9, the first embodiment includes valve sleeve 16, nozzle housing 18, and inlet 21. In one preferred form, this first embodiment may have a maximum throw radius of 24 feet (7.32 meters), which may be reduced to 17 feet (5.18 meters) or lower by adjustment of the radius adjustment valve 46. The maximum throw radius is controlled, in part, by the structure of the inlet 21 and the flow passages 74 in the nozzle housing 18. The whole flow path above the filter 50 is generally configured to have as minimal a change in flow area and flow direction (relative to other embodiments) to provide the longest throw radius. Again, the embodiments described herein provide examples of throw radiuses, and it should be evident that this disclosure is not limited to embodiments with any particular throw radius.

Figure 5:
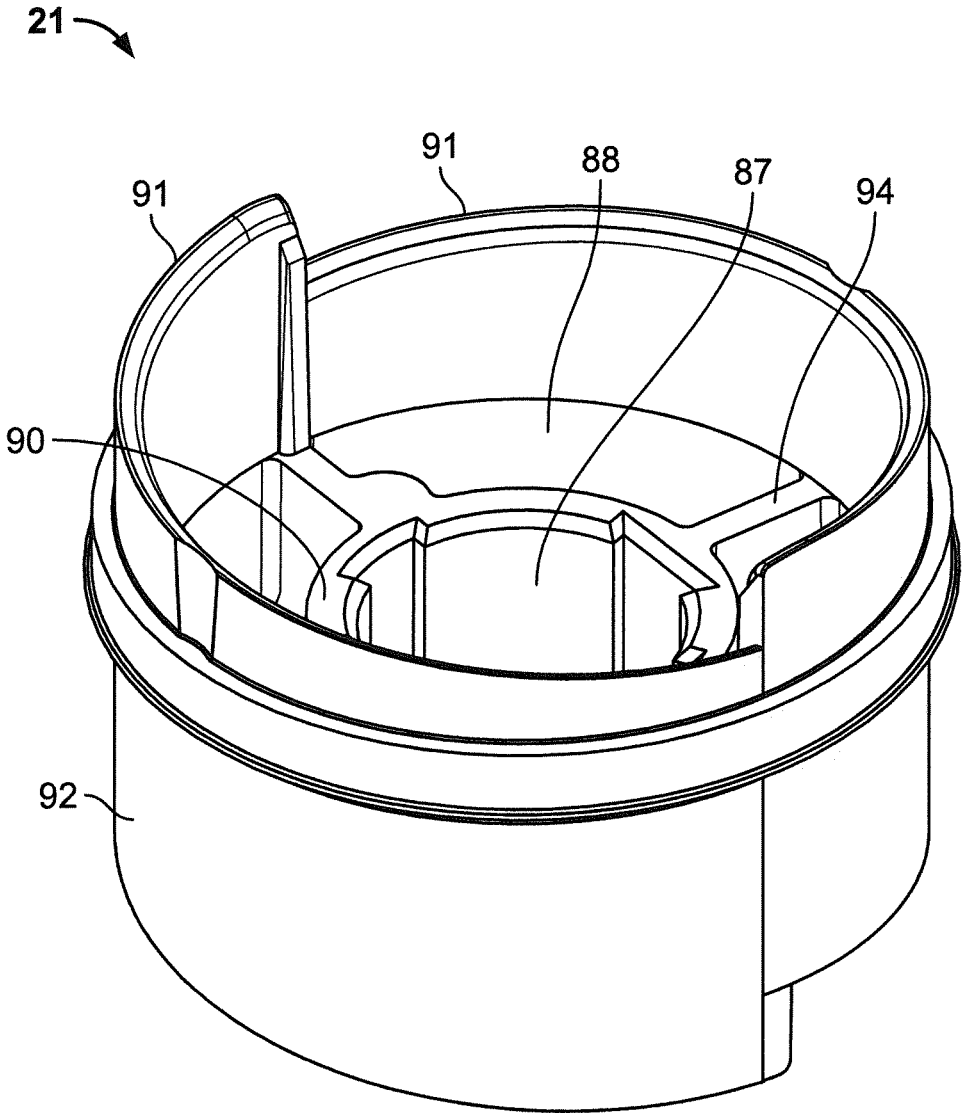
FIG. 5 is a perspective view of the inlet of the nozzle of FIG. 1.
Figure 6:
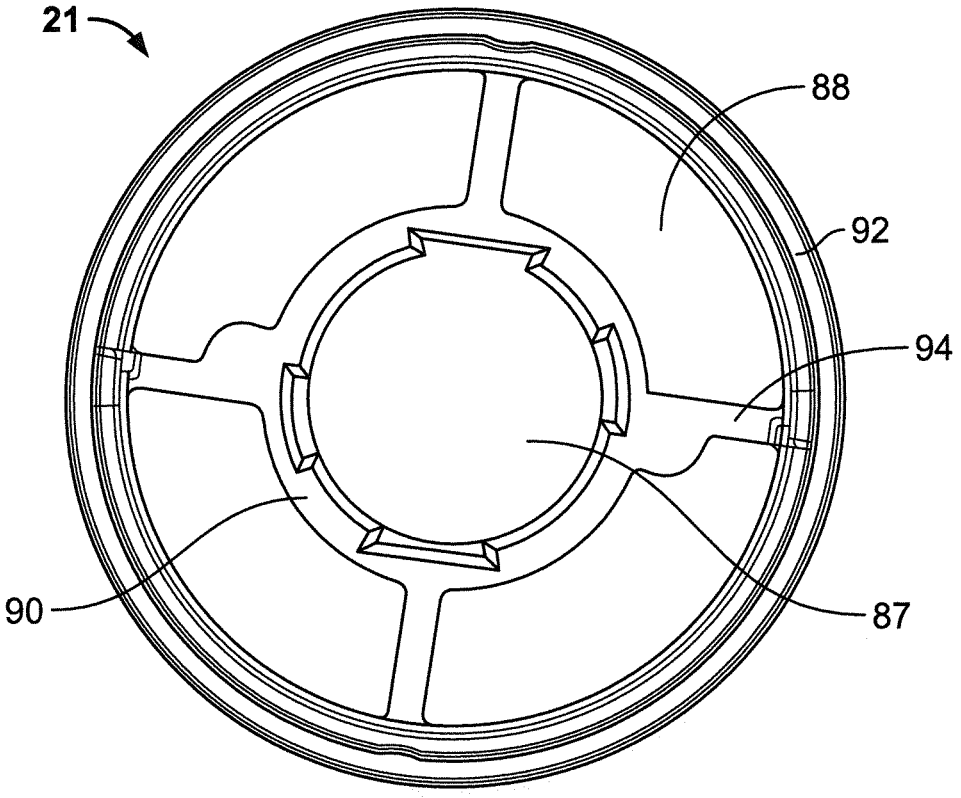
FIG. 6 is a top plan view of the inlet of the nozzle of FIG. 1.
Figure 7:
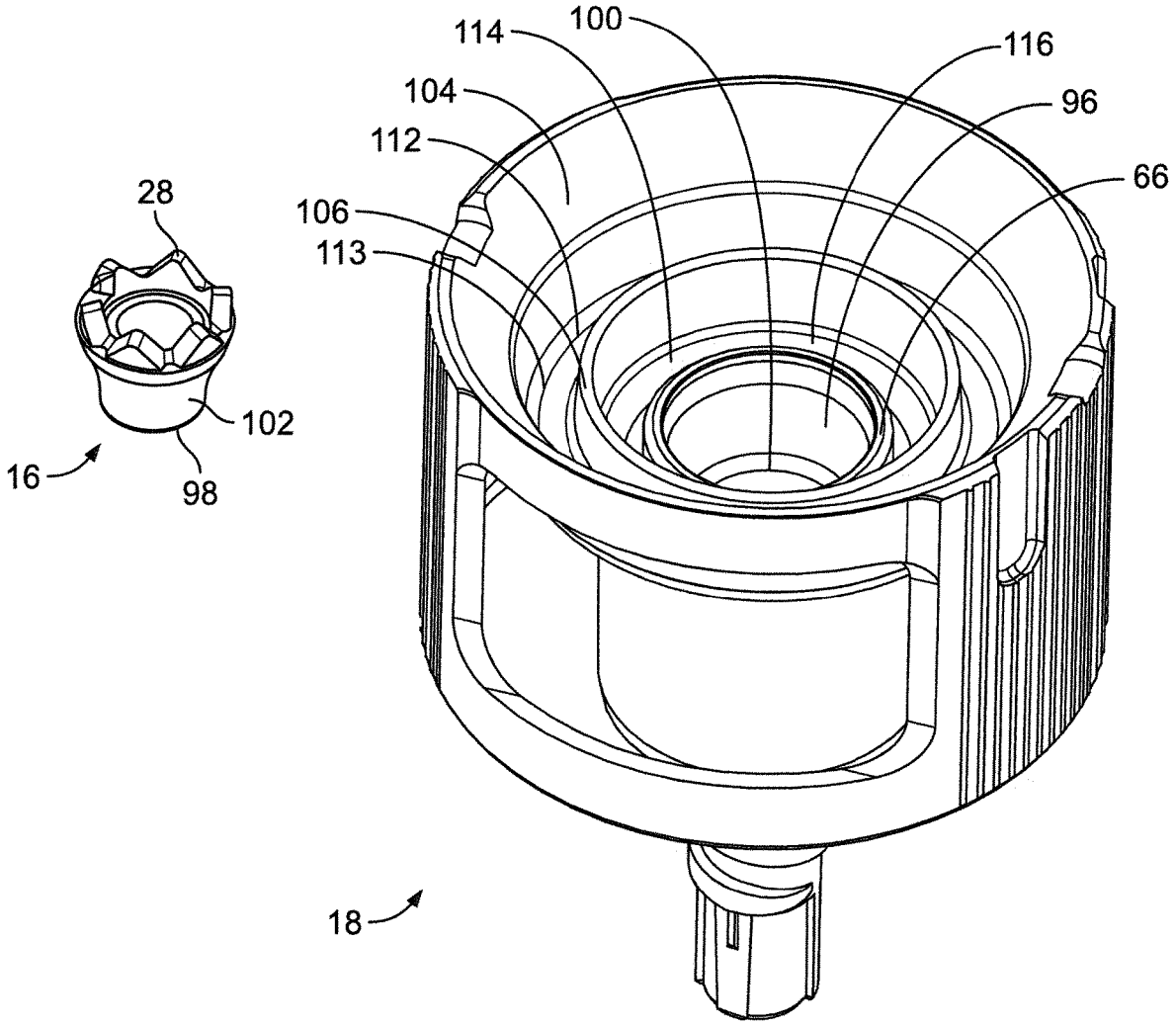
FIG. 7 is a top perspective view of the unassembled valve sleeve and nozzle housing of the nozzle of FIG. 1.
Figure 8:
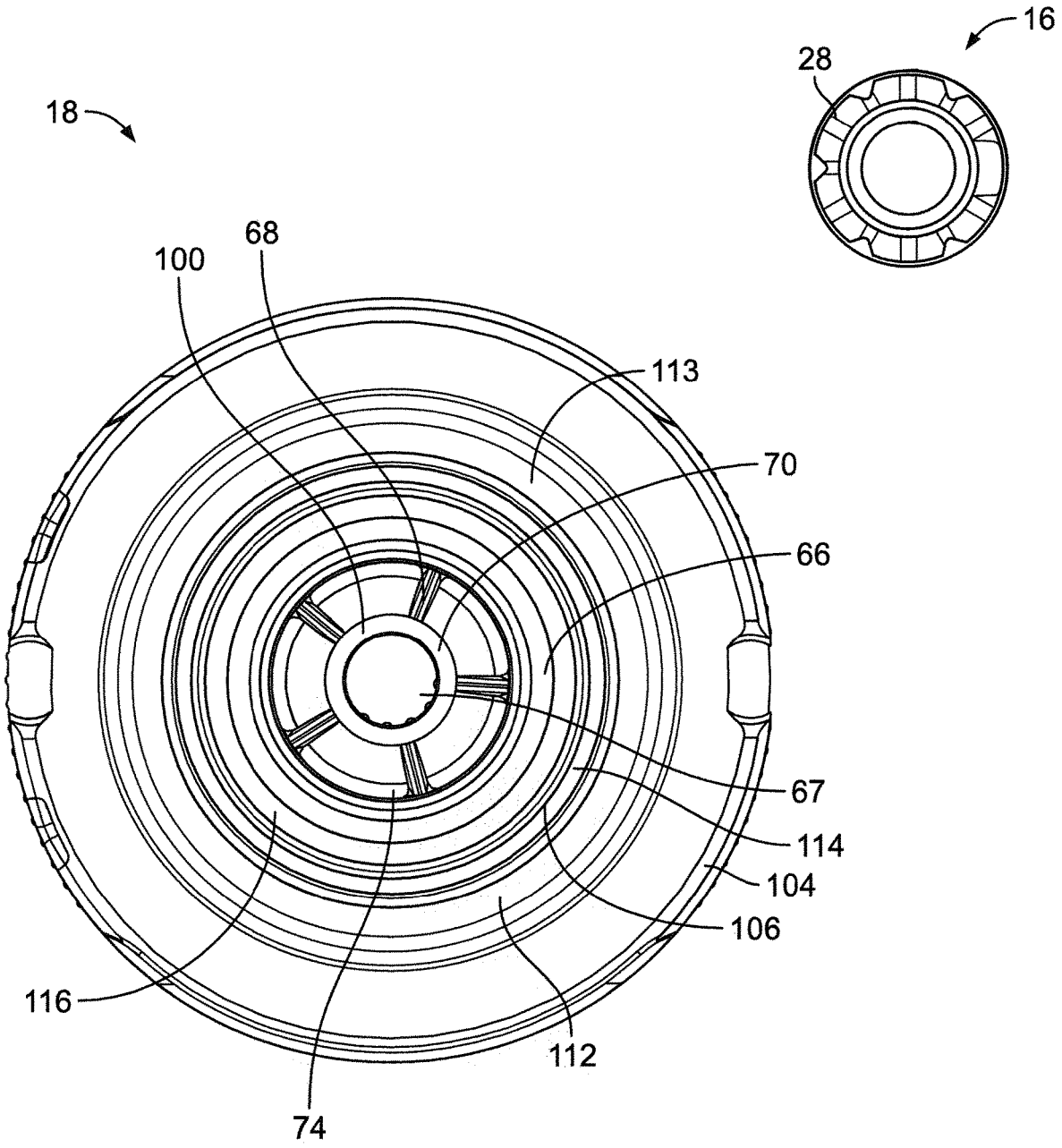
FIG. 8 is a top plan view of the unassembled valve sleeve and nozzle housing of the nozzle of FIG. 1.
Figure 9:
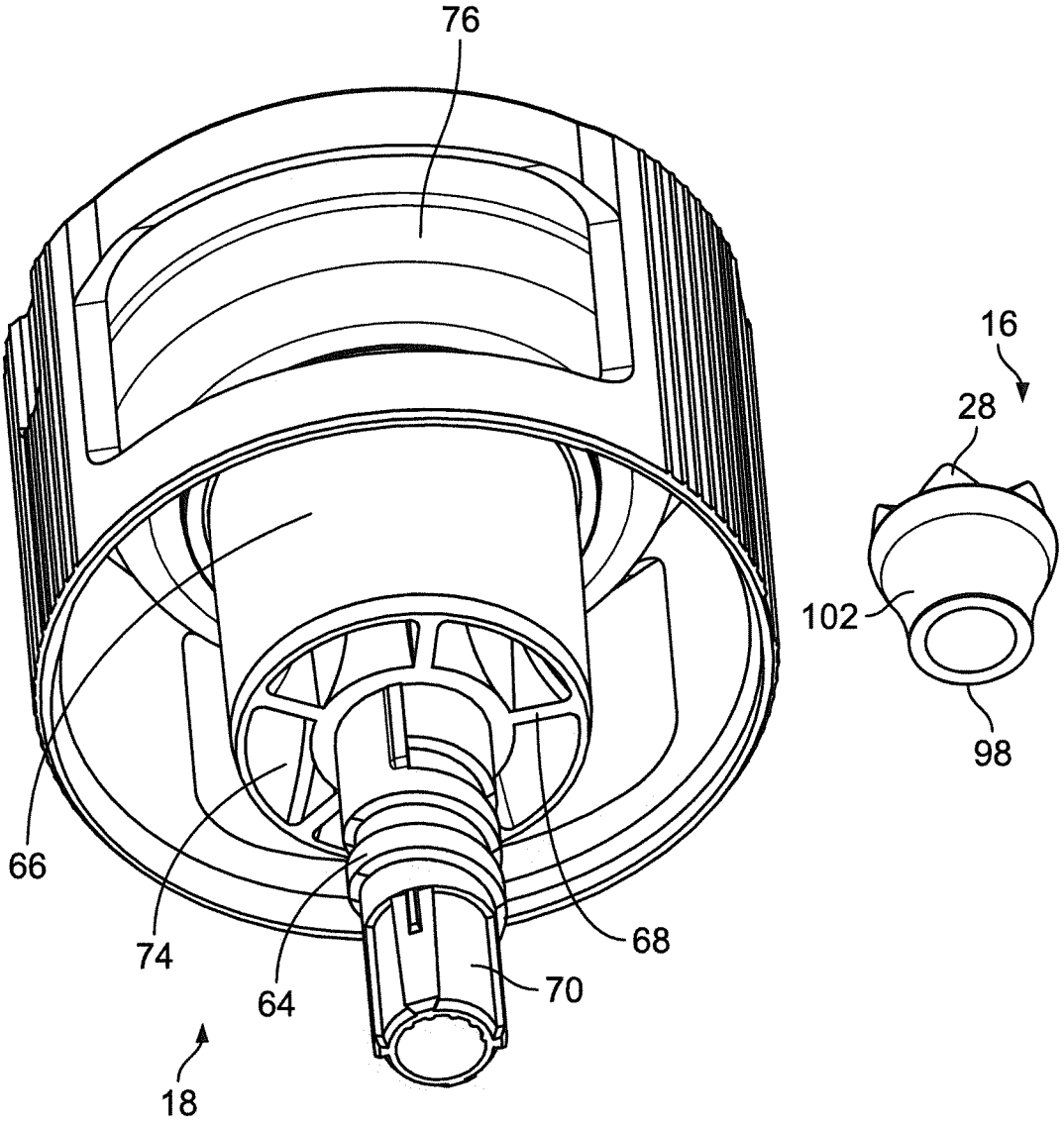
FIG. 9 is a bottom perspective view of the unassembled valve sleeve and nozzle housing of the nozzle of FIG. 1.

As shown in FIGS. 5 and 6, the inlet 21 is separated by ribs/spokes 94 and defines a bore 87 and separate and distinct flow passages 88 therethrough (which collectively define an annular flow passageway through the inlet 21). The bore 87 is sized to receive the end of the hollow post 64 of the nozzle housing 18 therein. The inlet 21 preferably has two helical portions 91 that are offset with respect to one another to define the helical top surface 79, and the flow control member 54 has two corresponding offset helical portions defining its bottom surface 78. As described above, this helical top surface 79 acts as a valve seat for the flow control member 54 that is moveable in an axial direction toward and away from the segmented helical top surface 79.

The flow passages 88 are defined by a central hub 90, an outer cylindrical wall 92, and four radial spokes 94 connecting the central hub 90 and outer wall 92. These four flow passages 88 have a relatively large cross-section and do not significantly restrict flow through the inlet 21 (in contrast to some embodiments discussed below). In other words, the flow passages 88 are generally sized so as not to significantly reduce the energy and velocity of fluid flowing through the inlet 21, in view of the fact that nozzle 10 is intended to have the longest throw radius of the embodiments described herein. Fluid flows up through the filter 50, through the flow passages 88 of the inlet 21, past the flow control member 54 (forming part of the radius adjustment valve 46), and then into the nozzle housing 18.

As shown in FIGS. 2 and 7-9, the valve sleeve 16 is received and nested within a recess 96 of the nozzle housing 18. The valve sleeve 16 has a flat, ring-shaped bottom surface 98 that is supported by a support surface 100 of the nozzle housing 18. The valve sleeve 16 also has a gently curved (radiused) outer wall 102 that guides upwardly flowing fluid into the annular exit orifice 15. The outer wall 102 is gently curved so as not to significantly reduce the energy and velocity of the upwardly directed fluid.

As addressed above, the spring 40 biases the valve sleeve 16 against the nozzle housing 18, i.e., it tightens the engagement between the valve sleeve 16 and nozzle housing 18. In other words, the spring 40 establishes a frictional engagement between the valve sleeve bottom surface 98 and the support surface 100 of the nozzle housing 18. In one preferred form, the valve sleeve 16 may use this frictional engagement to rotate the entire nozzle body 17 for convenient installation of the nozzle 10 onto a riser. More specifically, the valve sleeve teeth 28 and deflector teeth 26 may engage such that a user can install the nozzle 10 by pushing down on the deflector 12 to engage the valve sleeve 16. The user can then rotate the deflector 12 to rotate the valve sleeve 16 and the rest of nozzle body 17, including the nozzle base 80 (FIG. 2). This rotation allows the user to thread the nozzle 10 directly onto a retracted riser of an associated spray head. This feature is advantageous with users of a pop-up sprinkler because it eliminates the need to use a tool to lift the riser and install the nozzle 10.

The nozzle housing 18 preferably includes an outer cylindrical wall 104, an intermediate cylindrical wall 106, and the inner cylindrical wall 66. In one preferred form, these walls 104, 106, and 66 are intended to prevent grit and other debris from entering into sensitive areas of the nozzle 10, which may affect or even prevent operation of the nozzle 10. A first debris trap 110 is defined, in part, by the outer wall 104 that is inclined at an angle such that the outermost portion is at a higher elevation than the innermost portion. During normal operation, when grit, dirt, or other debris comes into contact with this outer wall 104, it may be guided into a first channel (or first annular depression) 112. The debris is prevented from moving from this first channel 112 by the intermediate wall 106. In other words, the first debris trap 110 is defined, in part, by the outer wall 104, first channel 112, and intermediate wall 106 such that debris is trapped in the first channel 112. As shown in FIGS. 2 and 7-9, a second debris trap 114 includes a second channel 116 (or second annular depression) disposed between the intermediate wall 106 and the inner wall 66. In other words, the debris traps 110 and 114 may include two separate annular channels 112 and 116, respectively, for capturing debris.

The nozzle housing 18 defines multiple flow passages 74 through its body, and in one preferred form, it defines five flow passages 74. The nozzle housing 18 preferably includes five spokes 68 that define, in part, these flow passages 74. As can be seen in FIG. 2, the upstream portion of the flow passages 74 are located at a distal radial location relative to the shaft 20, and the flow passages 74 then curve radially inwardly. In FIG. 2, the flow passages 74 terminate when fluid reaches the valve sleeve 16. At this stage, the outer wall 102 of the valve sleeve 16 and the inner wall 66 of the nozzle housing 18 define between them the annular exit orifice 15, which constricts due to the valve sleeve 16 as fluid proceeds through this gap 15. Accordingly, fluid initially flows into the flow passages 74 of the nozzle housing 18 and then flows through the annular exit orifice 15 (discharge gap) defined by the nozzle housing 18 and valve sleeve 16. It then exits the annular exit orifice 15, impacts the underside of the deflector 12, and is distributed radially outwardly from the deflector 12 in a full circle irrigation pattern. In one form, the width of the annular exit orifice 15 at the downstream end may be about 0.024 inches (0.061 mm), or between about 0.021 and 0.025 inches (0.053 mm and 0.064 mm). As should be evident, this is just one example, and the width may be of many different sizes, depending on the size and scaling of the nozzle 10.

A second embodiment (nozzle 200) is shown in FIGS. 10-14. In one preferred form, this second embodiment may have a maximum throw radius of 18 feet (5.49 meters), which may be reduced to 13 feet (3.96 meters) or less by adjustment of the radius adjustment valve 46. The maximum throw radius is controlled primarily by structure upstream of the annular exit orifice 215 ("upstream throttling"). More specifically, as addressed below, this maximum throw radius is controlled, in part, by the structure of the inlet 221 and the flow passages 274 in the nozzle housing 218.

In some ways, the inlet 221 is similar in shape and structure to inlet 21 of the first embodiment. Inlet 221 is generally cylindrical in shape and defines a bore 287 sized to receive the end of the hollow post 264 of the nozzle housing 218 therein. The inlet 221 again preferably has a helical top surface 279 (like helical top surface 79 shown in FIG. 5) that acts as a valve seat for the flow control member 54. Further, the profile (or thickness) and cross-sectional flow opening of the flow control member 54 itself may be adjusted in size in order to select a desired maximum throw radius.

Figure 11:
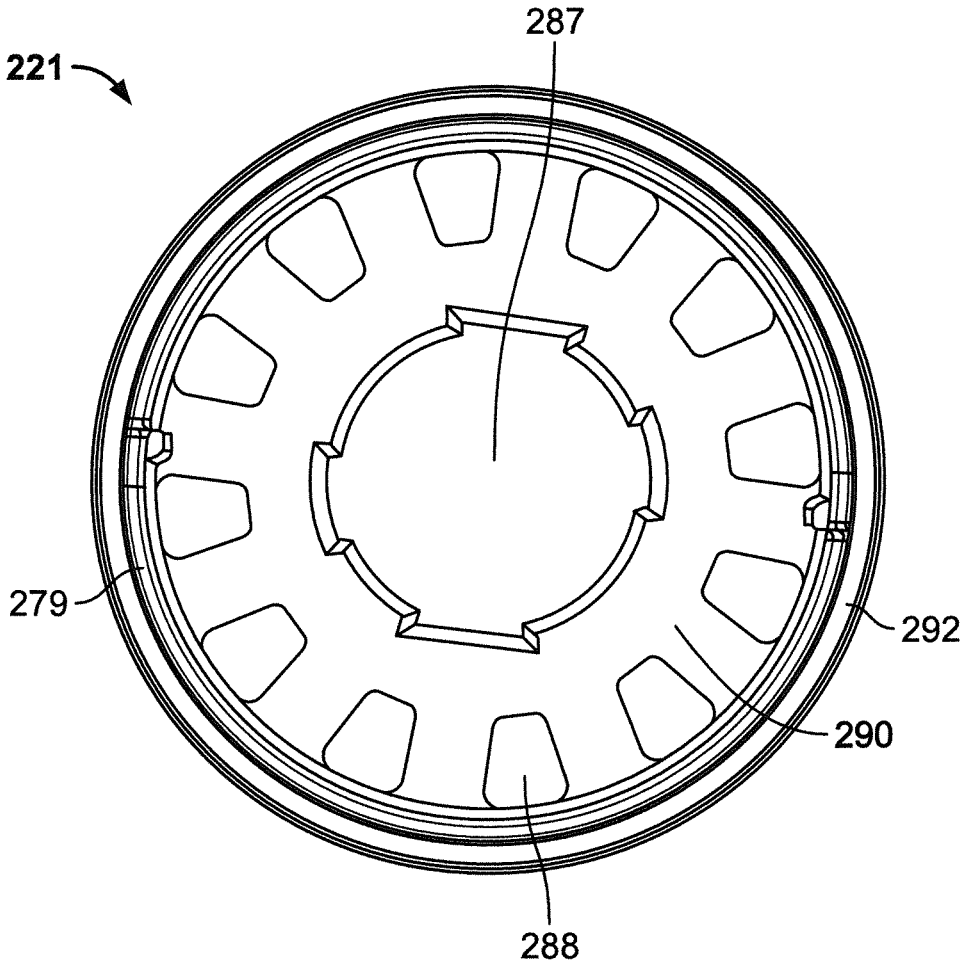
FIG. 11 is a top plan view of the inlet of the nozzle of FIG. 10.

However, as can be seen in FIG. 11, the flow passages 288 in the inlet 221 are different than those of the previous embodiment. More specifically, the flow passages 288 are arranged annularly about the central hub 290 of the inlet 221, and in one preferred form, there are twelve such circumferentially spaced flow passages 288. The annularly arranged flow passages 288 collectively define an annular flow path through the inlet 221. In this form, the cross-section of each flow opening 288 is preferably in the general shape of a trapezoid having rounded corners. As should be evident, the size, number and shape of these flow passages 288 can be varied to provide the desired flow restriction necessary for the flow rate and radius requirements of the nozzle 200. In view of this ability to vary the size, number and shape of the flow passages to introduce a flow restriction, the inlets described herein may be referred to generally as flow restrictable inlets. In contrast to the flow passages 88 of the first embodiment, these flow passages 288 each preferably have a relatively narrow cross-section and function as a flow restriction through the flow restrictable inlet 221.

In other words, the flow passages 288 are generally sized to reduce the energy and velocity of fluid flowing through the inlet 221, in view of the fact that nozzle 200 is intended to have an intermediate throw radius relative to the embodiments described herein. These flow passages 288 are arranged annularly in order to provide an even and balanced flow through the inlet 221 and through the rest of the nozzle 200. In one form, they may be spaced equidistantly from one another and radially distant from the bore 287, i.e., adjacent the outer cylindrical wall 292. This flow restriction occurs at a point upstream of the annular exit orifice 215. Fluid flows up through the filter 50, through the flow passages 288 of the inlet 221, past the radius adjustment valve 46, and then into the nozzle housing 218.

Figure 12:
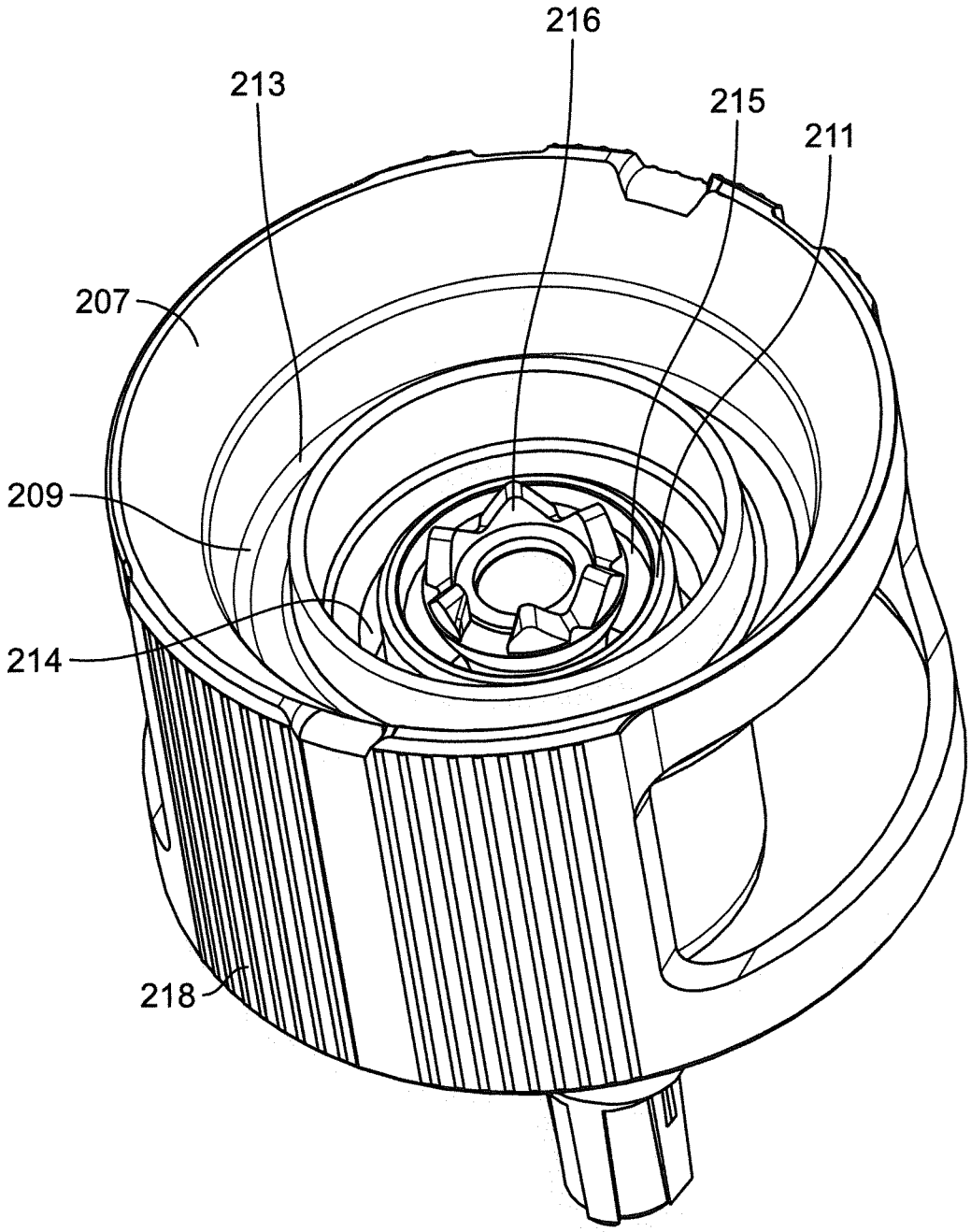
FIG. 12 is a top perspective view of the assembled valve sleeve and nozzle housing of the nozzle of FIG. 10.
Figure 13:
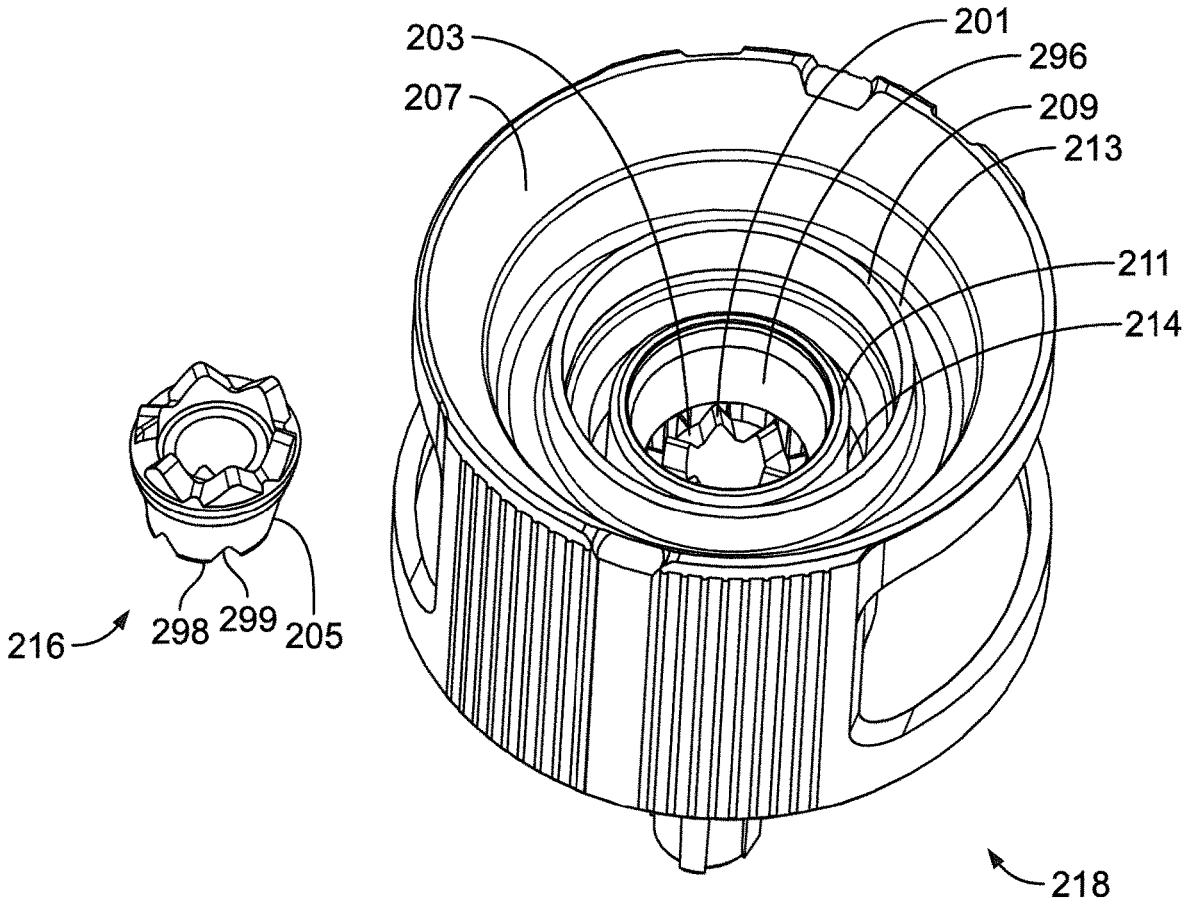
FIG. 13 is a top perspective view of the unassembled valve sleeve and nozzle housing of the nozzle of FIG. 10.
Figure 14:
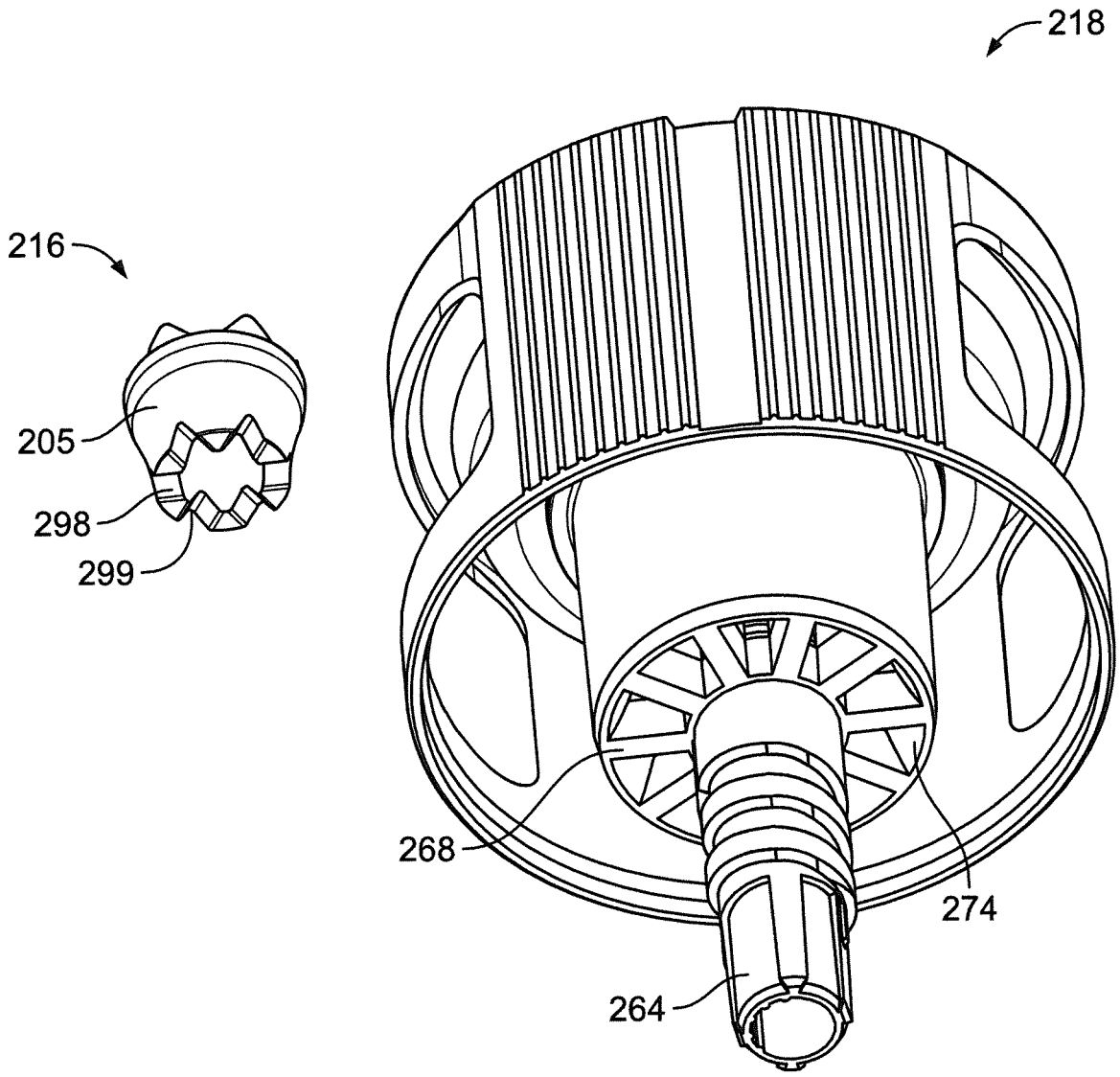
FIG. 14 is a bottom perspective view of the unassembled valve sleeve and nozzle housing of the nozzle of FIG. 10.

As shown in FIGS. 12-14, the valve sleeve 216 is received and nested within a recess 296 of the nozzle housing 218. In this preferred form (unlike the first embodiment), the valve sleeve 216 has a bottom surface 298 with teeth 299 therein for engaging corresponding teeth 201 in a support surface 203 of the nozzle housing 218. The valve sleeve 216 also has a gently curved outer wall 205 that guides upwardly flowing fluid in the annular exit orifice 215.

In this preferred form, this toothed engagement may facilitate engagement of valve sleeve 216 and nozzle housing 218 to rotate the entire nozzle body 217 for convenient installation of the nozzle 100 onto a riser. Like the first embodiment), a user can install the nozzle 200 by pushing down on the deflector 12 to engage the valve sleeve 216 and thereby the rest of the associated nozzle 200. The user can then rotate the deflector 12 to rotate the valve sleeve 216 (and the nozzle 200) to allow the user to thread the nozzle 200 directly onto the retracted riser of an associated spray head.

The nozzle housing 218 is similar in shape in some ways to the nozzle housing 18 of the first embodiment. It preferably includes an outer cylindrical wall 207, an intermediate cylindrical wall 209, and an inner cylindrical wall 211. These walls 207, 209, and 211 define debris traps 213 and 214 therebetween (the first debris trap 213 is between walls 207 and 209 and the second debris trap 214 is between walls 209 and 211).

Figure 10:
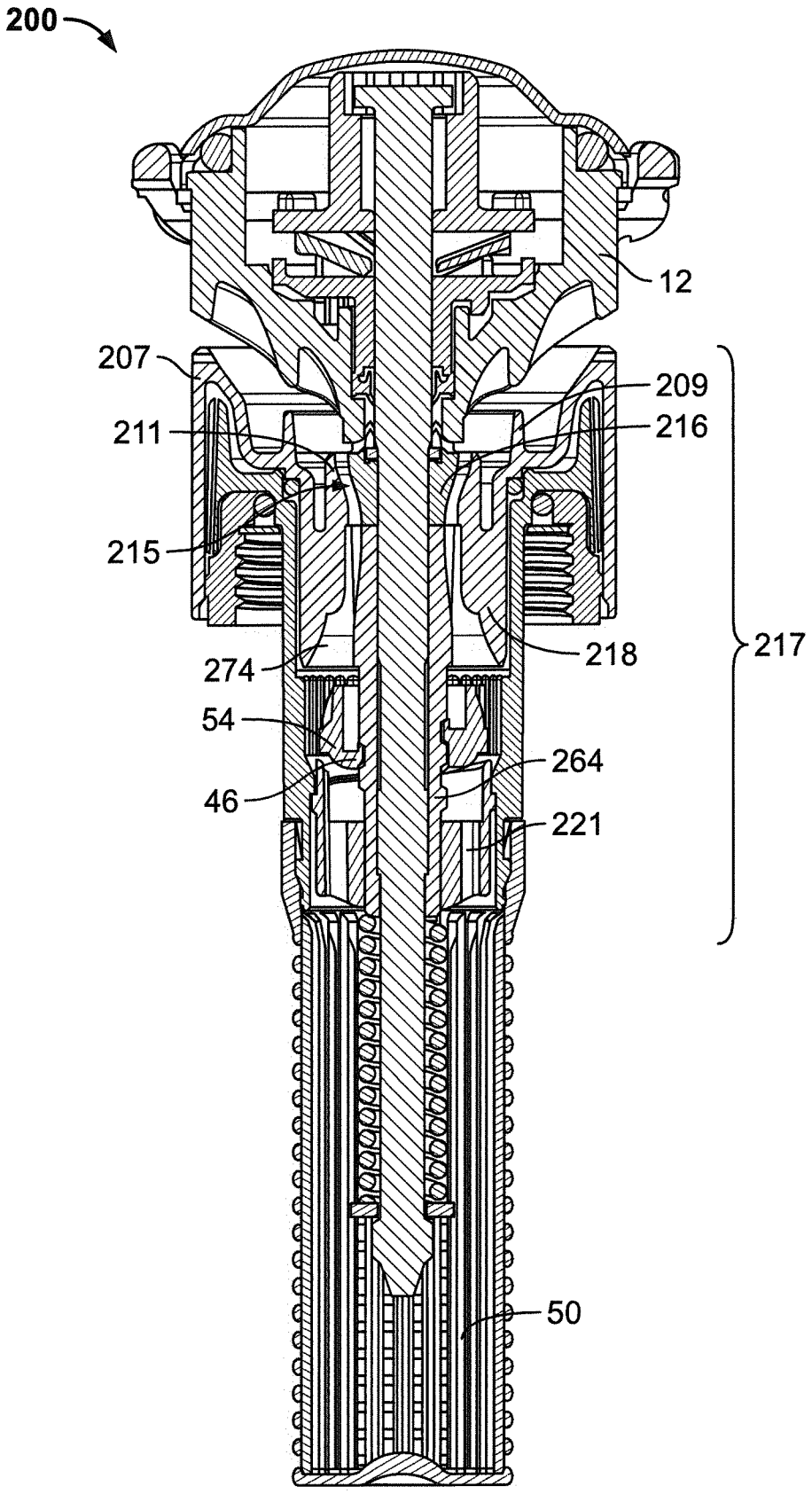
FIG. 10 is a cross-sectional view of a second embodiment of a nozzle embodying features of the present invention.

The nozzle housing 218 also defines multiple flow passages 274 through its body, but these flow passages 274 are different than the flow passages 74 of the first embodiment. There are more flow passages 274, and in one preferred form, the nozzle housing 218 includes ten flow passages 274, which are defined by ten spokes 268. As can be seen in FIG. 10, the upstream portion of the flow passages 274 have a generally wide opening or entrance, and the flow passages 274 taper upstream from the annular exit orifice 215. This tapering acts as a second flow restriction (in addition to the first flow restriction at the inlet 221) upstream of the gap 215. The tapering preferably provides a progressive and controlled reduction in cross-sectional area so as to provide the desired pressure and velocity at the annular exit orifice 215 downstream. The flow passages 274 terminate when fluid reaches the valve sleeve 216, and at this point, the outer wall 205 of the valve sleeve 216 and the inner wall 211 of the nozzle housing 218 define between them the annular exit orifice 215 (or discharge gap). Fluid exiting the annular exit orifice 215 strikes the underside of the deflector 12 and is distributed radially outwardly from the deflector 12 in a full circle irrigation pattern.

A third embodiment (nozzle 300) is shown in FIGS. 15-18. In one preferred form, this third embodiment may have a maximum throw radius of 14 feet (4.27 meters), which may be reduced to 8 feet (2.44 meters) by adjustment of the radius adjustment valve 46. Like the second embodiment (nozzle 200), the maximum throw radius is controlled primarily by structure upstream of the annular exit orifice 315 ("upstream throttling"). More specifically, as addressed below, this maximum throw radius is controlled, in part, by the structure of the inlet 321 and the flow passages 374 in the nozzle housing 318.

The inlet 321 is similar in structure to the first embodiment (inlet 21) and the second embodiment (inlet 221). Inlet 321 is generally cylindrical in shape and defines a bore 387 that receives the end of the hollow post 364 of the nozzle housing 318. It again preferably has a helical top surface 379 (like helical top surface 79 shown in FIG. 5 and described above) that acts as a valve seat for the flow control member 54. Again, the profile (or thickness) and cross-sectional flow opening of the flow control member 54 itself may be adjusted in size in order to select a desired maximum throw radius.

Figure 16:
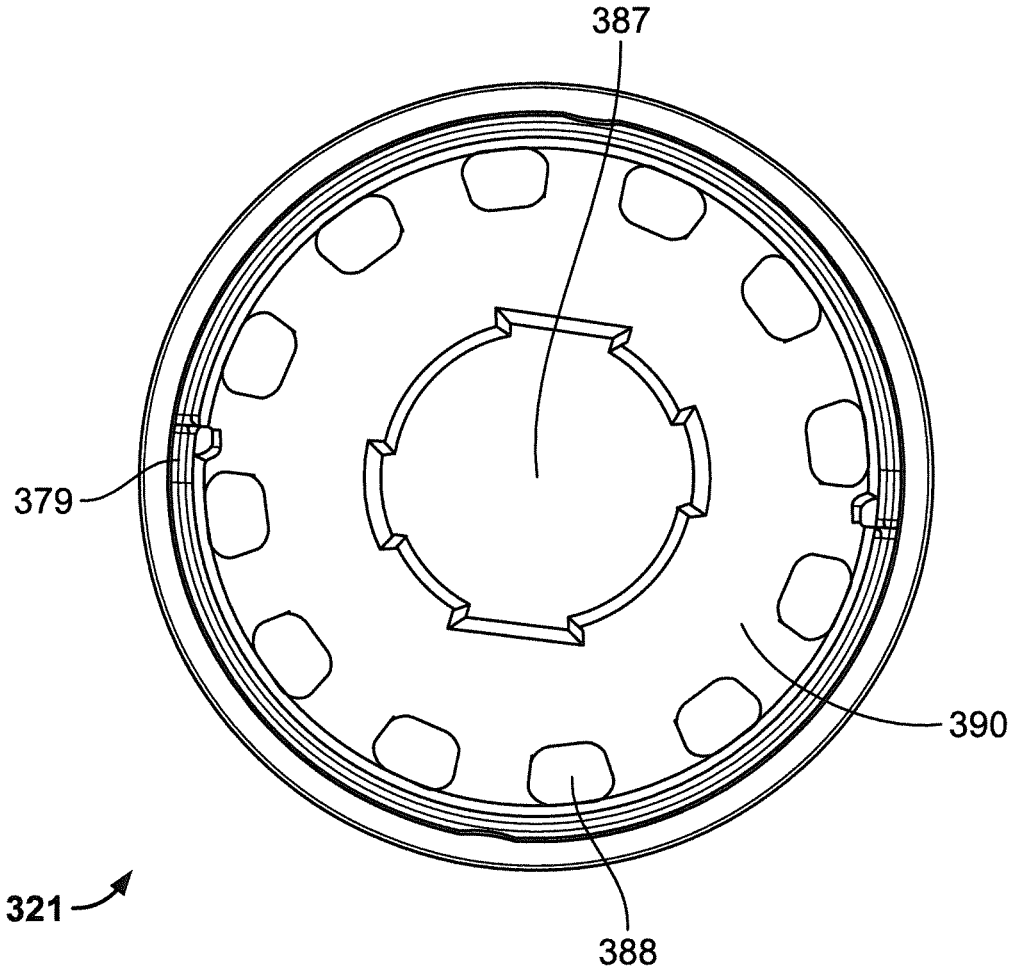
FIG. 16 is a top plan view of the inlet of the nozzle of FIG. 15.

However, as can be seen in FIG. 16, the flow passages 388 in the inlet 321 are different. The flow passages 388 are spaced circumferentially about the central hub 390 of the inlet 321, and in one preferred form, there are twelve such circumferentially spaced flow passages 388. They are preferably spaced equidistantly from one another and radially distant from the bore 387 so as to provide an even and balanced flow through the inlet 321 and through the rest of the nozzle 300. The cross-section of each flow opening 388 generally has an obround (or race track) shape or may have a circular or oval shape, depending on what is required, for example, based on injection mold tooling parameters. In contrast to the flow passages 88 of the first embodiment, these flow passages 388 each have a relatively narrow cross-section and act as a flow restriction through the inlet 321. Further, these flow passages 388 have a smaller combined cross-sectional area than the combined cross-sectional area of the flow passages 288 of the second embodiment (nozzle 200). As should be evident, the number and cross-sectional area of the flow passages 388 may be selected to adjust to a desired maximum throw radius.

The flow passages 388 are generally sized to reduce the energy and velocity of fluid flowing through the inlet 321, in view of the fact that nozzle 300 is intended to have the shortest maximum throw radius relative to the embodiments described herein. Like the second embodiment (nozzle 200), this flow restriction occurs at a point upstream of the annular exit orifice 315. Fluid flows up through the filter 50, through the flow passages 388 of the inlet 321, past the radius adjustment valve 46, and then into the nozzle housing 318.

Figure 17:
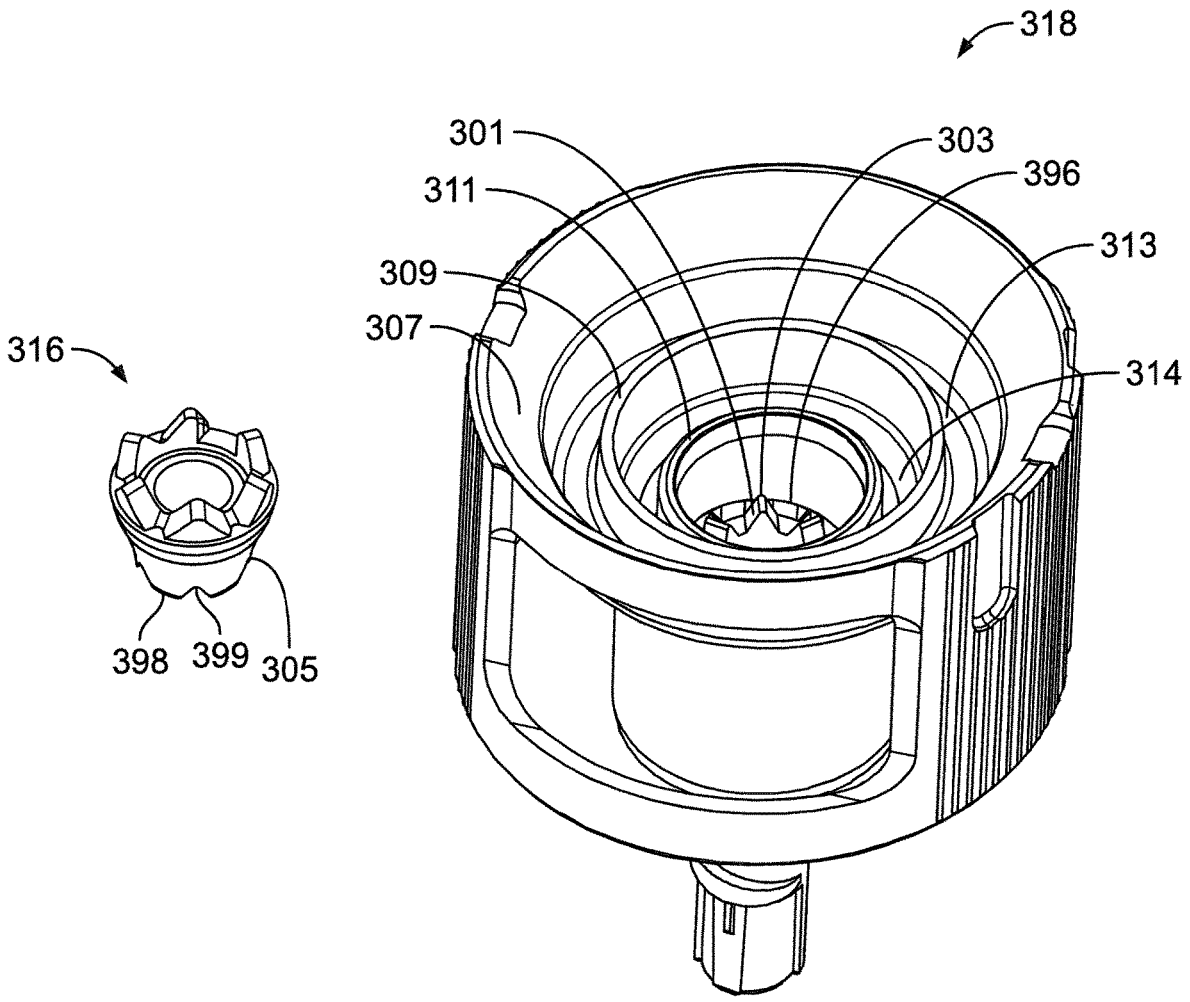
FIG. 17 is a top perspective view of the unassembled valve sleeve and nozzle housing of the nozzle of FIG. 15.

As shown in FIGS. 17 and 18, the valve sleeve 316 is received and nested within a recess 396 of the nozzle housing 318. Like the second embodiment (nozzle 200), the valve sleeve 316 preferably has a bottom surface 398 with teeth 399 therein for engaging corresponding teeth 301 in a support surface 303 of the nozzle housing 318. The valve sleeve 316 again has a gently curved outer wall 305 that guides upwardly flowing fluid in the annular exit orifice 315. Further, like the first and second embodiments, a user can install the nozzle 300 by pushing down the deflector 12 to engage the deflector teeth 26 with the teeth 399 of the valve sleeve 316 and rotating to allow the user to thread the nozzle 300 directly onto the riser of an associated spray head.

The nozzle housing 318 includes some of the structure and features of the nozzle housings 18 and 218 of the first and second embodiments, respectively. It preferably includes debris traps 313 and 314. More specifically, it includes an outer cylindrical wall 307, an intermediate cylindrical wall 309, and an inner cylindrical wall 311 (with the first debris trap 313 being defined by walls 307 and 309 and the second debris trap 314 being defined by walls 309 and 311).

Figure 15:
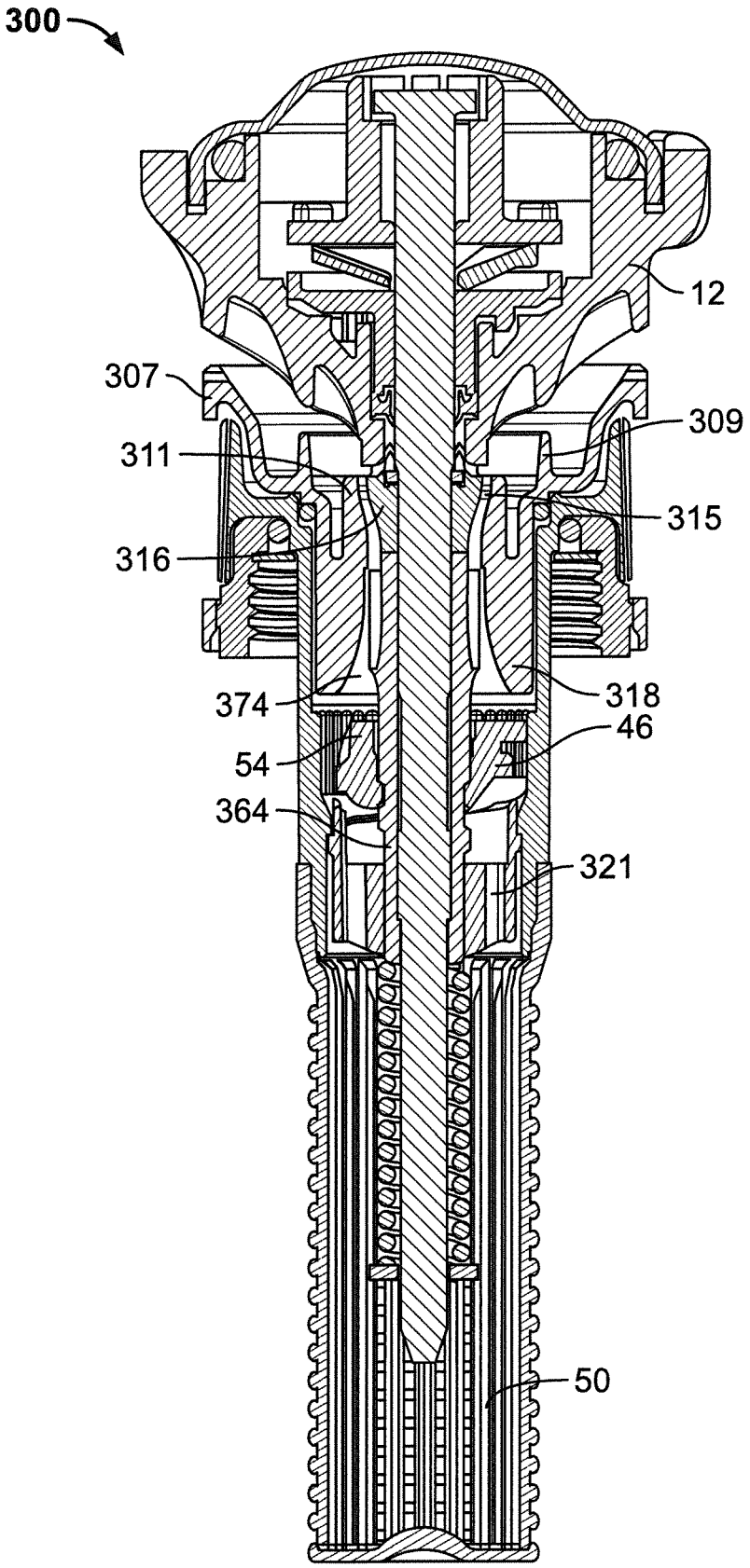
FIG. 15 is a cross-sectional view of a third embodiment of a nozzle embodying features of the present invention.

The flow passages 374 of the nozzle housing 318 are different than the flow passages 74 of the first embodiment (nozzle 10). In one preferred form, the nozzle housing 318 includes ten flow passages 374 defined by ten spokes 368. As can be seen in FIG. 15, the upstream portion of the flow passages 374 have a generally wide opening or entrance, and the flow passages 374 taper upstream from the annular exit orifice 315. This tapering acts as a second flow restriction (in addition to the first flow restriction at the inlet 321) upstream of the gap 315. The rate of tapering (constriction) and the start of the tapering may be adjusted or fine-tuned (preferably near the start of the flow passages 374) in order to achieve a desired flow rate and velocity at the annular exit orifice 315 downstream. The constriction preferably starts at an earlier upstream point than the flow passages 274 of the second embodiment to achieve a lower desired exit velocity and produce a shorter maximum throw radius.

The flow passages 374 end at the valve sleeve 316. At this point in the flow path, the outer wall 305 of the valve sleeve 316 and the inner wall 311 of the nozzle housing 318 define between them the annular exit orifice 315. Fluid flows through the flow passages 374, through the annular exit orifice 315, impacts the underside of the deflector 12, and is distributed radially outwardly from the deflector 12 in a full circle irrigation pattern.

A fourth embodiment (nozzle 400) is shown in FIGS. 19-23. In one preferred form, this fourth embodiment may have a nominal design throw radius of 18 feet (5.49 meters), which may be reduced to 13 feet (3.96 meters) by adjustment of the radius adjustment valve 46. The general range of throw radius is therefore like that of the second embodiment (nozzle 200). However, unlike the second embodiment (nozzle 200), the nominal design throw radius is controlled primarily by the nozzle structure at or just before the annular exit orifice 415 ("downstream throttling"). More specifically, as addressed below, this maximum throw radius is controlled, in part, by the combination of the structure of the valve sleeve 416 and nozzle housing 418 at or just before the annular exit orifice 415.

Figure 20:
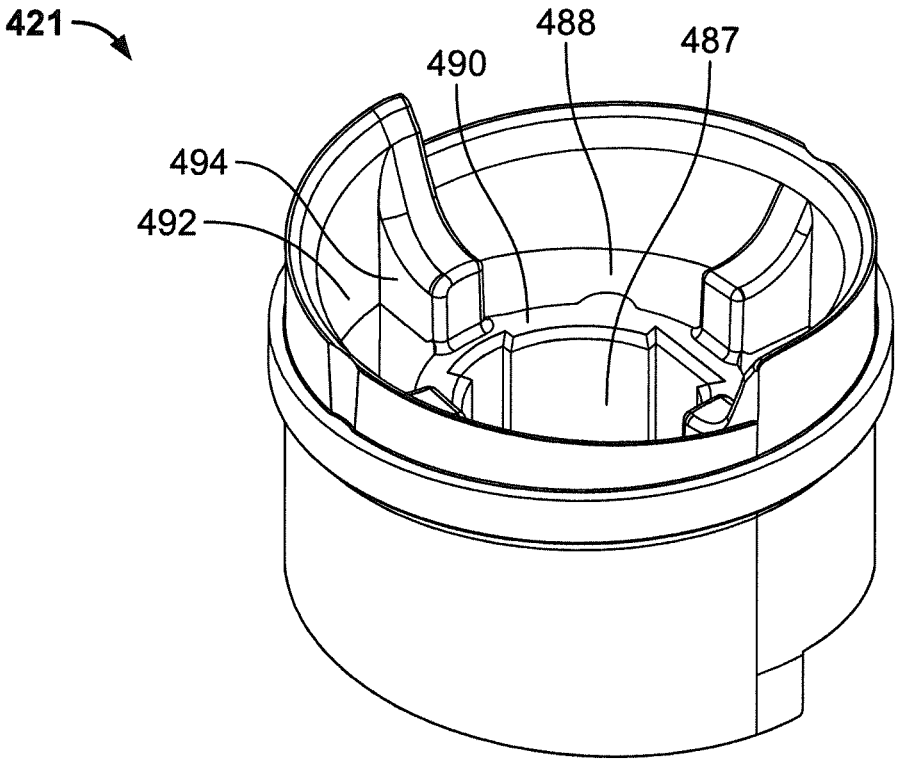
FIG. 20 is a perspective view of the inlet of the nozzle of FIG. 19.
Figure 21:
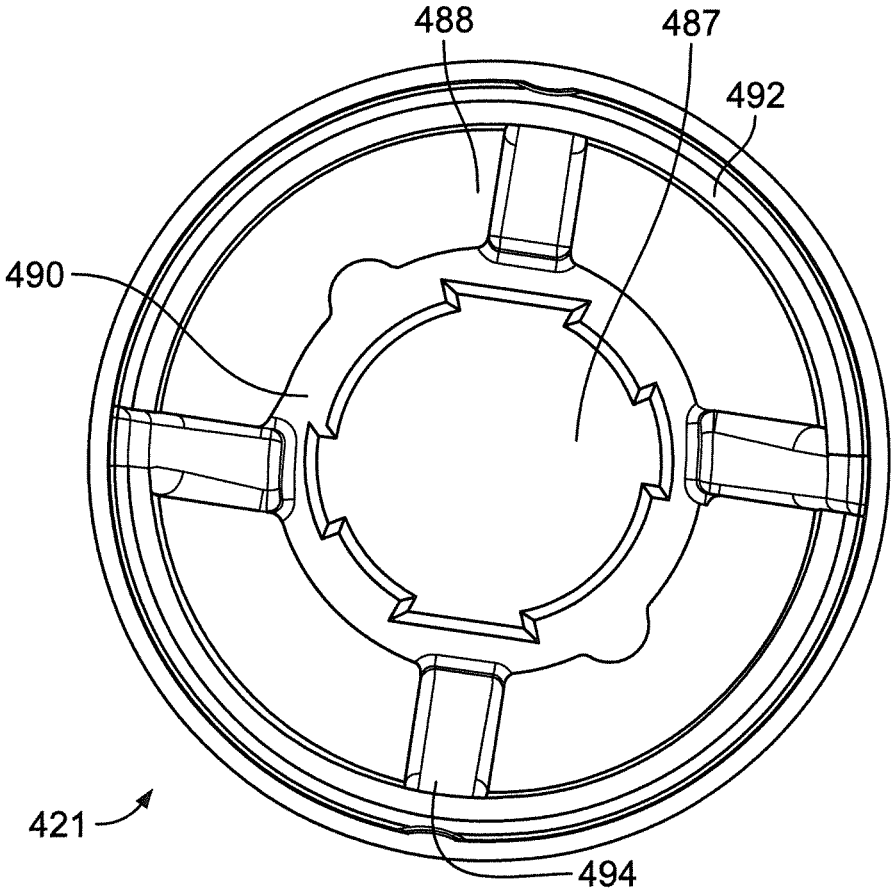
FIG. 21 is a top plan view of the inlet of the nozzle of FIG. 19.

As shown in FIGS. 20 and 21, an inlet 421 similar to the inlet 21 from the first embodiment (nozzle 10) having a bore 487 and four flow passages 488 is preferably used. The four arcuate flow passages 488 are defined by a central hub 490, an outer cylindrical wall 492, and four radial spokes 494 connecting the central hub 490 and outer wall 492. The general discussion above regarding inlet 21 is incorporated herein, but the four flow passages 488 preferably define a smaller cross-sectional area than those of inlet 21. The radial spokes 494 are preferably thicker and extend further in an axial direction to provide greater flow restriction than inlet 21, in view of the desired reduced maximum throw radius relative to the first embodiment. Fluid flows up through the filter 50, through the flow passages 488 of the inlet 421, past the radius adjustment valve 46, and then into the nozzle housing 418.

Figure 19:
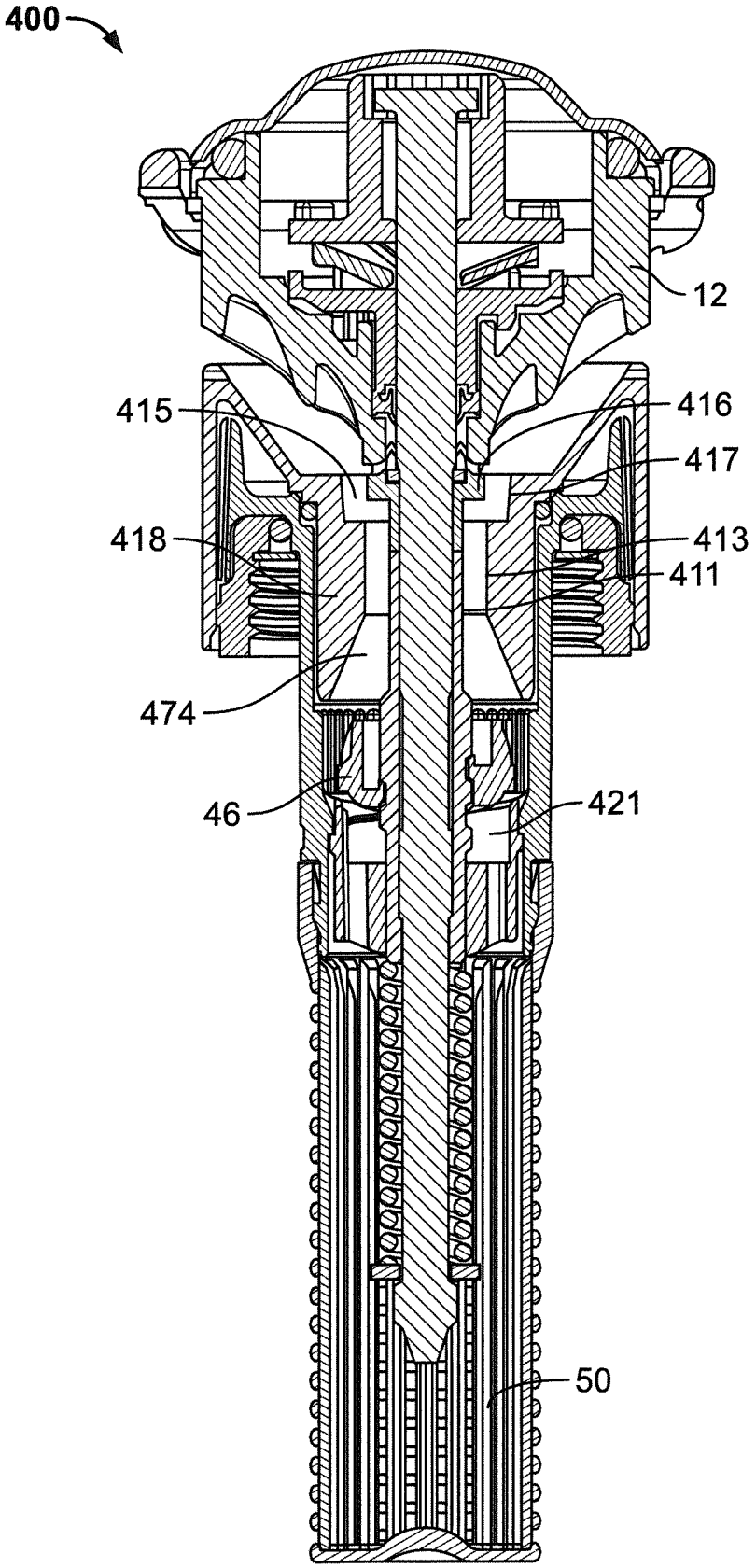
FIG. 19 is a cross-sectional view of a fourth embodiment of a nozzle embodying features of the present invention.
Figure 22:
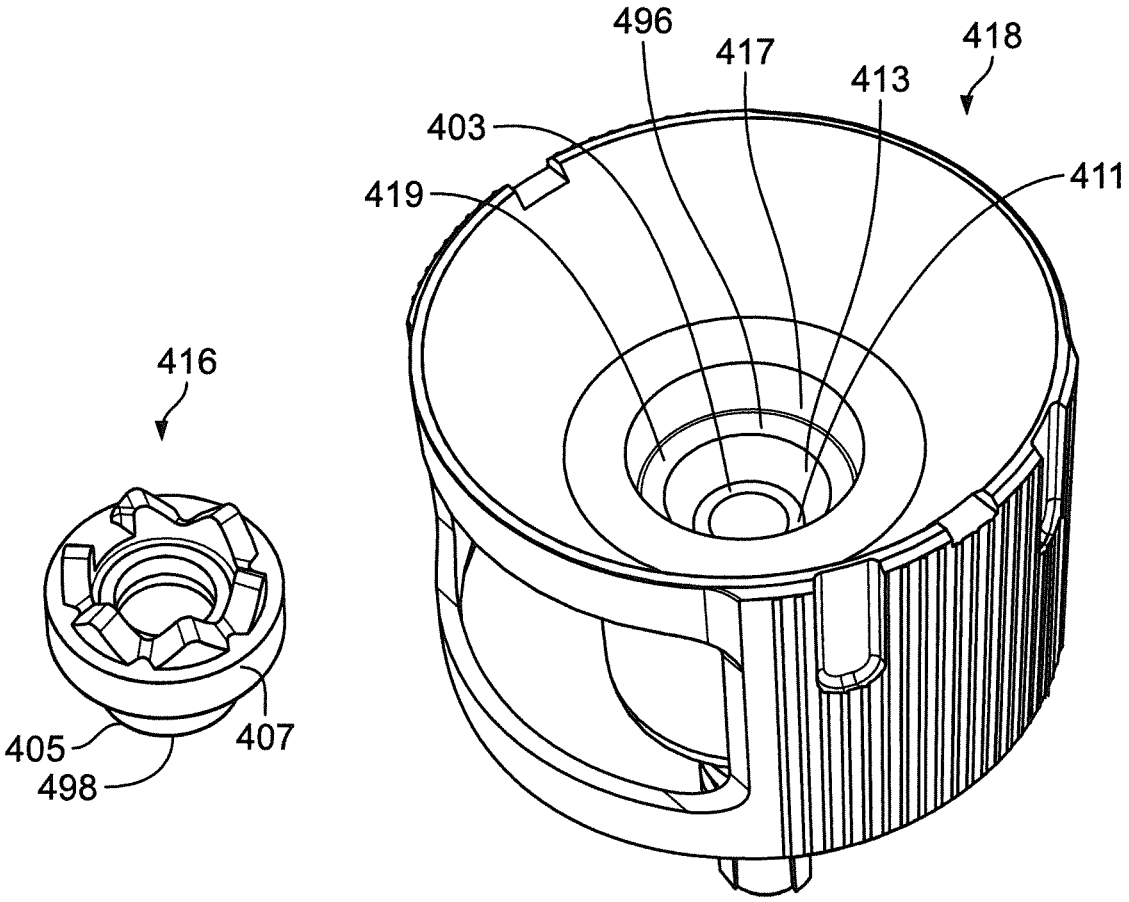
FIG. 22 is a top perspective view of the unassembled valve sleeve and nozzle housing of the nozzle of FIG. 19.
Figure 23:
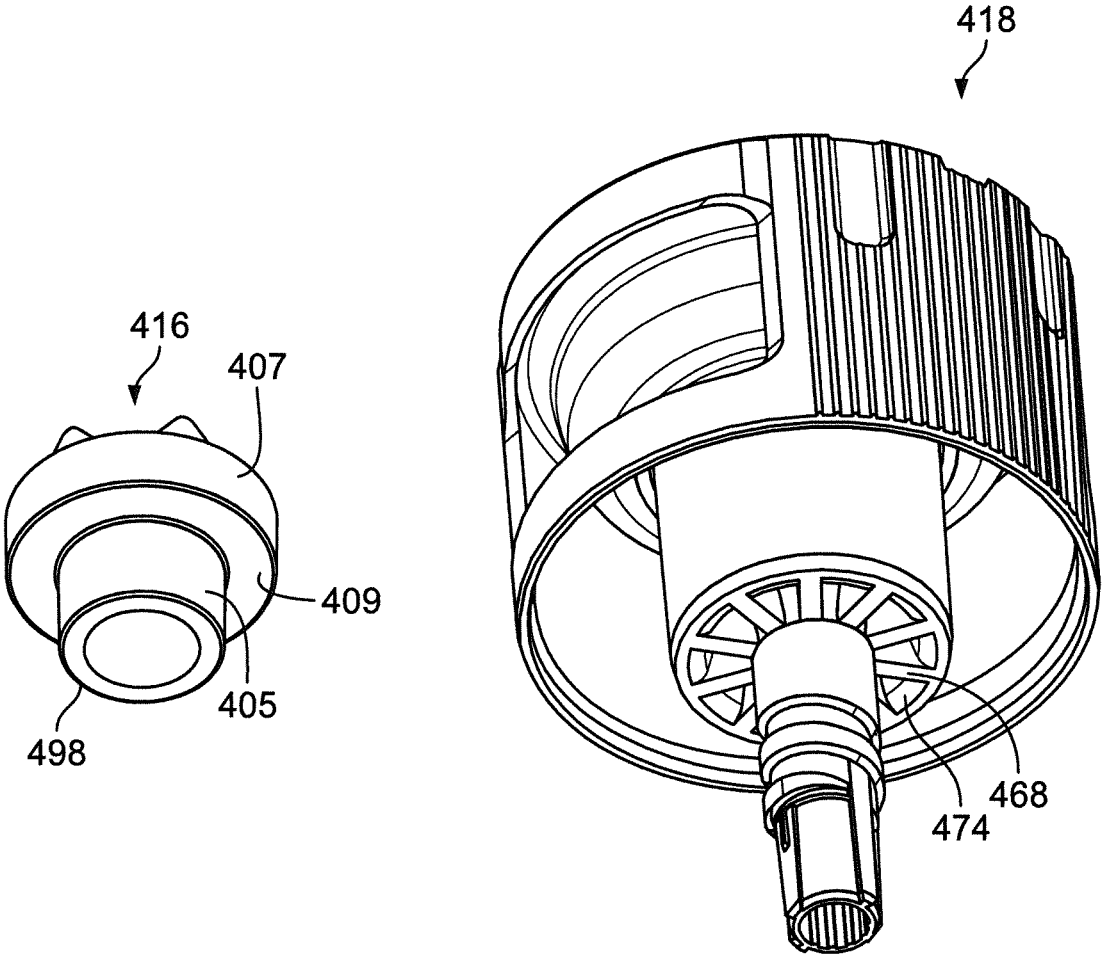
FIG. 23 is a bottom perspective view of the unassembled valve sleeve and nozzle housing of the nozzle of FIG. 19.

As shown in FIGS. 19, 22, and 23, the valve sleeve 416 is nested within a recess 496 of the nozzle housing 418. Like the first embodiment (nozzle 10), the valve sleeve 416 preferably has a flat, ring-shaped bottom surface 498 that engages a corresponding ring-shaped support surface 403 of the nozzle housing 418. Like the first embodiment (nozzle 10), this frictional engagement preferably permits a user to push down and rotate the valve sleeve 416 to rotate the entire nozzle 400 and thread it onto a retracted riser during installation.

The valve sleeve 416 preferably has a first cylindrical outer wall 405 disposed upstream (beneath) a second cylindrical outer wall 407 with the second outer wall 407 having a larger radius than the first outer wall 405. It also includes a second ring-shaped horizontal surface 409 connecting the first outer wall 405 and second outer wall 407. As addressed further below, this structure creates a dogleg (or zigzag) in the flow path at and just before the annular exit orifice 415, resulting in loss of energy and velocity at this exit orifice 415.

The nozzle housing 418 includes structure that defines the flow path through its structure, including a first cylindrical wall 411, a second cylindrical wall 413, a third cylindrical wall 417, an annular ledge 419 connecting the second and third cylindrical walls 413 and 417, and flow passages 474. In one preferred form, the nozzle housing 418 includes ten flow passages 474 defined by ten spokes 468 connecting the first and second cylindrical walls 411 and 413. As can be seen from the figures, the flow passages 474 have a generally wide opening or entrance and then taper to and terminate in a narrower cross-section. Fluid flows into and through the flow passages 474 and then upwardly in an annular flow path until impacting the horizontal surface 409 of the valve sleeve 418, which flares radially outwardly into the flow path. This impact disrupts fluid flow, resulting in a loss of energy and velocity. As can be seen from FIGS. 19, 22, and 23, the flow path at this point is defined by the combination of the valve sleeve 416 (second outer wall 407 and horizontal surface 409) and the nozzle housing 418 (third cylindrical wall 417). Fluid then flows through the annular exit orifice 415 (between second outer wall 407 and third cylindrical wall 417), impacts the underside of the deflector 12, and is distributed radially outwardly from the deflector 12 in a full circle irrigation pattern.

A fifth embodiment (nozzle 500) is shown in FIGS. 24-27. In one preferred form, this fifth embodiment may have a nominal design throw radius of 14 feet (4.27 meters), which may be reduced to 8 feet (2.44 meters) by adjustment of the radius adjustment valve 46. The general range of throw radius is therefore like that of the third embodiment (nozzle 300). However, unlike the third embodiment (nozzle 300), the maximum throw radius is controlled primarily by the nozzle structure at or just before the annular exit orifice 515 ("downstream throttling"). More specifically, as addressed below, this maximum throw radius is controlled, in part, by the combination of the structure of the valve sleeve 516 and nozzle housing 518 at or just before the annular exit orifice 515.

The inlet 421 from the fourth embodiment is preferably used (FIGS. 20 and 21), and the above description of inlet 421 is incorporated herein. The inlet 421 has four flow passages 488 permitting flow through the inlet 421. Fluid flows up through the filter 50, through the flow passages 488 of the inlet 421, past the radius adjustment valve 46, and then into the nozzle housing 518.

As shown in FIGS. 24-27, the valve sleeve 516 is nested within a recess 596 of the nozzle housing 518. The valve sleeve 516 of the fifth embodiment has certain structure similar to the valve sleeve 416 of the fourth embodiment (nozzle 400), including a first cylindrical outer wall 505 disposed upstream (beneath) a second cylindrical outer wall 507 with the second outer wall 507 having a larger radius than the first outer wall 505. However, valve sleeve 516 also includes different structure. First, the valve sleeve 516 preferably has a key portion 501 (or protrusion) projecting from a bottom surface 598 that is received within a corresponding notch 503 (or recess) of the nozzle housing 518 (which helps maintain the clocked alignment of the valve sleeve 516 relative to the nozzle housing 518, as addressed below). Second, it preferably includes a number of circumferentially spaced segments (or ribs) 509 disposed on the first outer wall 505. As addressed further below, this structure creates a zig-zag (or break) in the flow path at and just before the annular exit orifice 515, resulting in loss of energy and velocity at this exit orifice 515.

Figure 24:
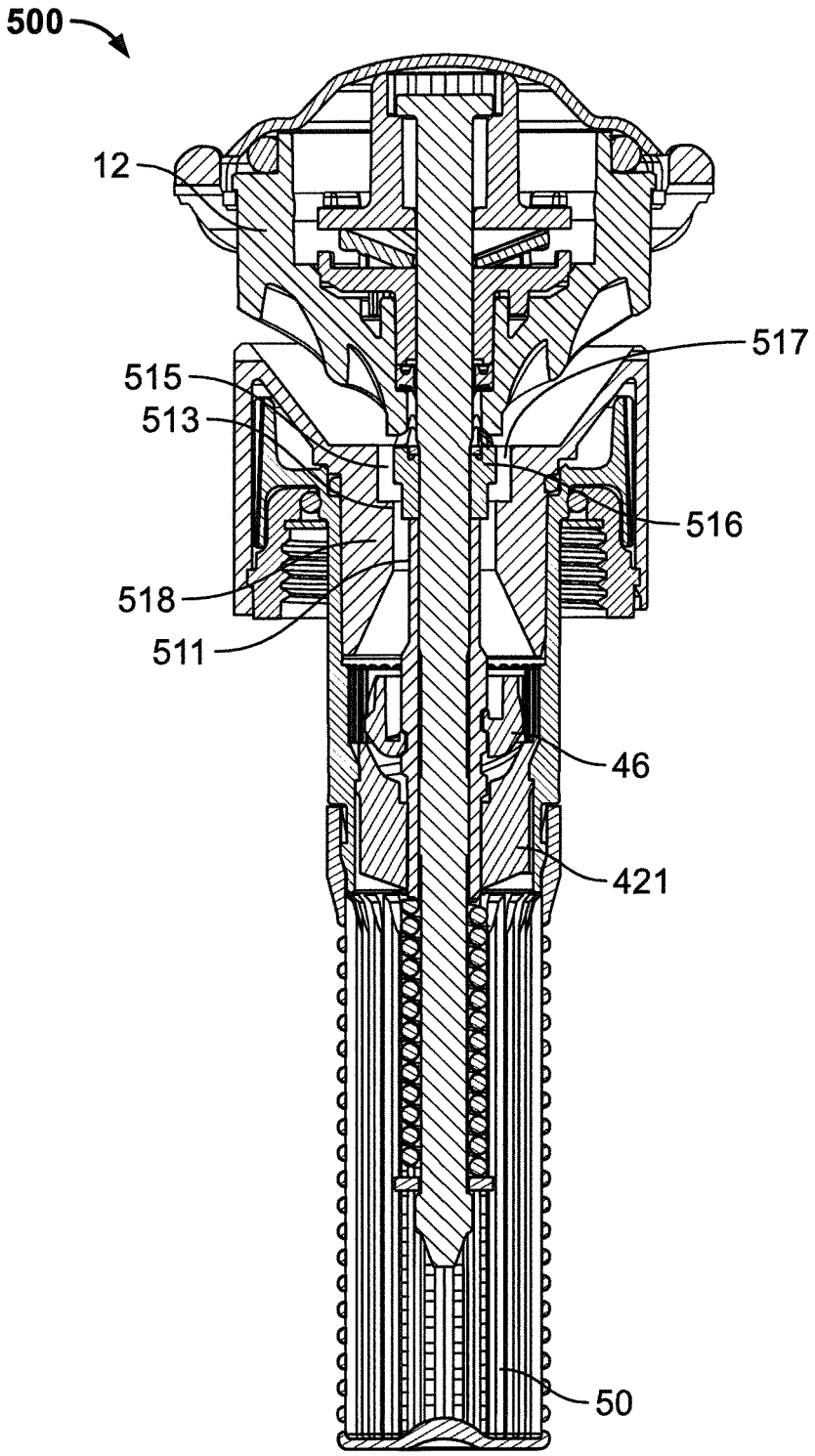
FIG. 24 is a cross-sectional view of a fifth embodiment of a nozzle embodying features of the present invention.
Figure 25:
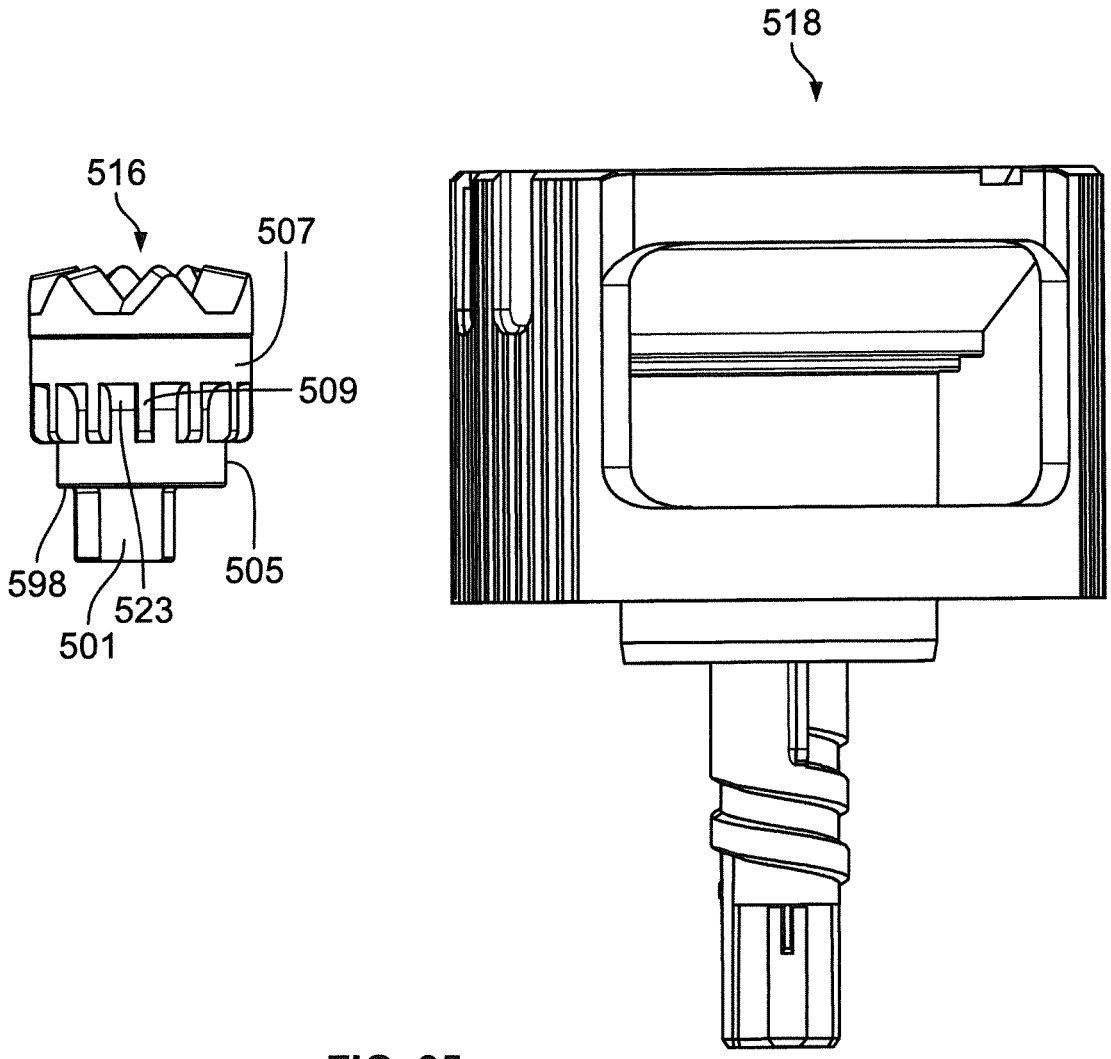
FIG. 25 is a side elevational view of the unassembled valve sleeve and nozzle housing of the nozzle of FIG. 24.
Figure 26:
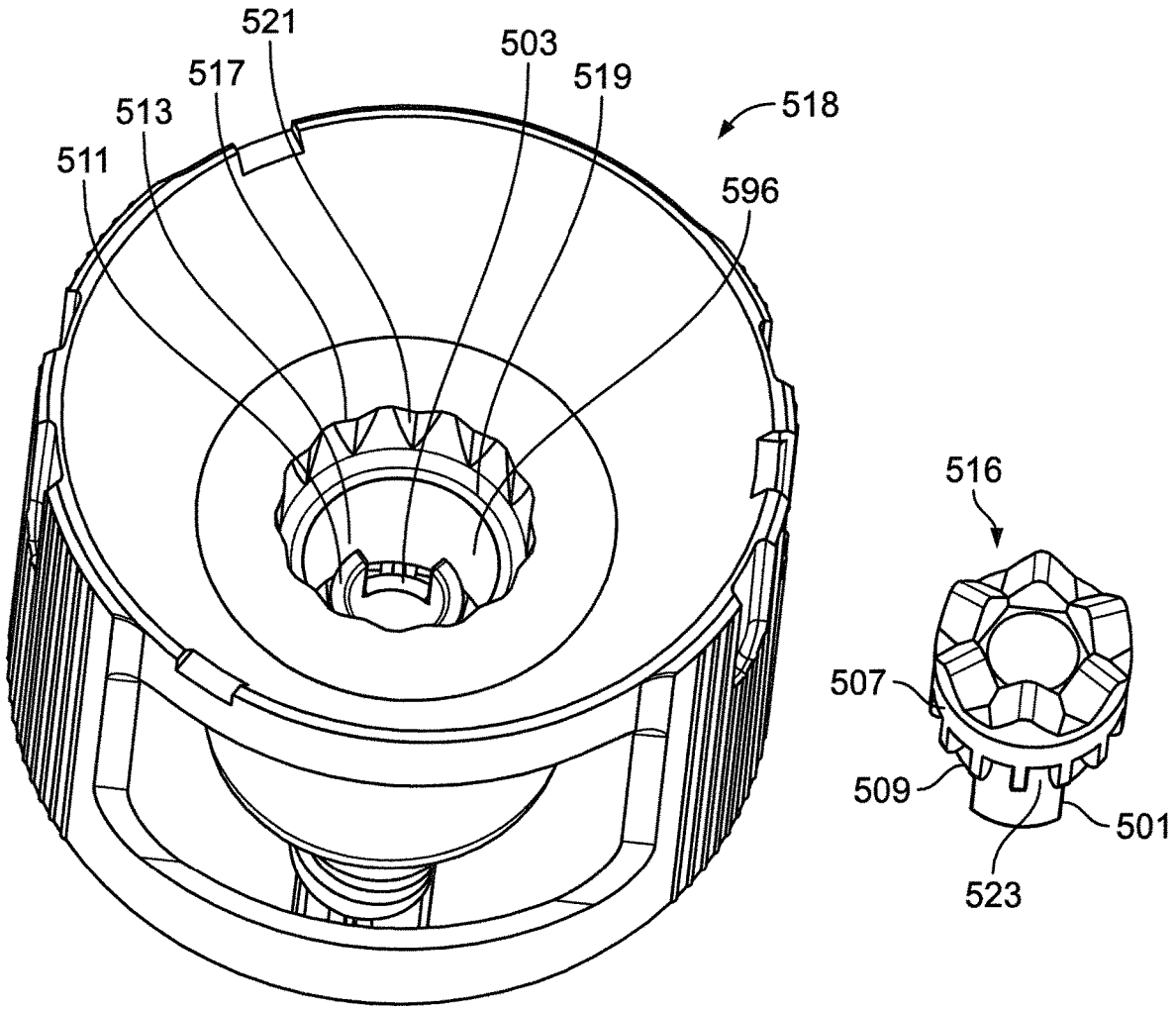
FIG. 26 is a top perspective view of the unassembled valve sleeve and nozzle housing of the nozzle of FIG. 24.
Figure 27:
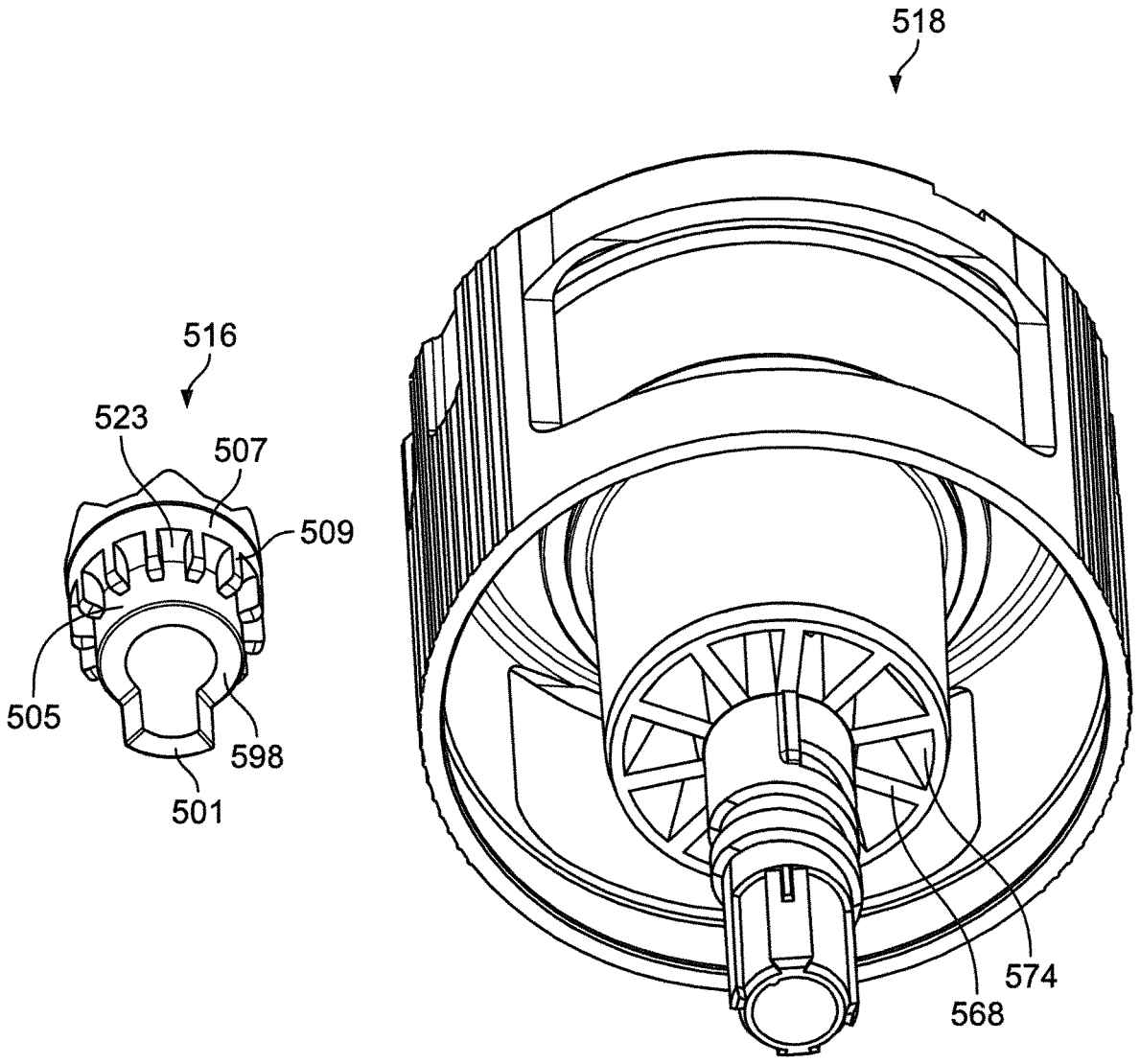
FIG. 27 is a bottom perspective view of the unassembled valve sleeve and nozzle housing of the nozzle of FIG. 24.

The nozzle housing 518 also includes some structure similar to the fourth embodiment (nozzle 400) but also includes different features (such as notch 503 and a scalloped wall 517). The nozzle housing 518 includes structure that defines the flow path through its interior, including a first cylindrical wall 511, a second cylindrical wall 513, a scalloped wall 517, an annular ledge 519 connecting the walls 513 and 517, and flow passages 574. In one preferred form, the nozzle housing 518 includes ten flow passages 574 defined by ten spokes 568 connecting the first and second cylindrical walls 511 and 513. As can be seen in FIG. 24, the flow passages 574 have a generally wide opening or entrance and then taper to and terminate in a narrower cross-section. Fluid flows into and through the flow passages 574 and then upwardly in an annular flow path until impacting the valve sleeve 516, which flares radially outward into the flow path. This impact disrupts fluid flow, resulting in a loss of energy and velocity. As can be seen from the figures, the flow path at this point is defined by the combination of the valve sleeve 516 (second outer wall 507 and ribs 509) and the nozzle housing 518 (scalloped wall 517). Fluid flows through the flow channels 523 defined by the ribs 509, then flows through the annular exit orifice 515 (between second outer wall 507 and scalloped wall 517), impacts the underside of the deflector 12, and is distributed radially outwardly from the deflector 12 in a full circle irrigation pattern.

In this preferred form, the segments/ribs 509 produce segmented fluid streams. Fluid initially proceeds vertically through the interior of the nozzle housing 518, is then directed radially outwardly, and then again proceeds generally vertically through the annular exit orifice 515. Without the scalloped wall 517, it has been found that the resulting streams directed toward the deflector 12 produce a spoky and uneven appearing irrigation pattern. When the scalloping in the scalloped wall 517 is angularly aligned or clocked in alignment with the segments/ribs 509, the resulting streams produce a more even irrigation pattern. In one preferred form, the valve sleeve includes 13 ribs 509 defining 13 flow channels 523, and the nozzle housing 518 includes 13 individual scallops 521, i.e., the convex rounded projections extending radially into wall 515. In this preferred form, each scallop 521 is angularly aligned with a rib 509. In other words, the centerline of each rib 509 is preferably aligned with a centerline of one of the scallops 521. The key portion 501 (or protrusion) helps maintain the proper angular or clocked alignment assuring the proper alignment of both features in the nozzle housing 518 and valve sleeve 516.

As addressed above, it is generally contemplated that any deflector suitable for distributing fluid radially outward may be used with the nozzles described herein. However, the nozzles may also use a specialized form of deflector that has been found to generally increase the maximum throw radius. As described further below, these specialized deflectors include curved flutes or vanes (or grooves or channels) on their underside that are "laterally offset." This lateral offset means generally that, if extended, the flutes or vanes do not extend to the axis of the deflector. Instead, they generally terminate at a certain radial distance "offset" from the center. Further, the use of this lateral offset allows the use of "straighter" flutes/vanes than previously used, i.e., the flutes/vanes have a larger radius of curvature. The fluid impacting the deflector drives the deflector more efficiently, i.e., the fluid loses less energy and may be distributed a further distance from the deflector. By adjusting the lateral offset and curvature of the flutes/vanes, one can tune both the drive torque and the distance of throw for specific nozzles. In effect, the same or greater radius can be achieved for a given nozzle utilizing lower and more laminar flow from the annular exit orifice of the nozzle using laterally offset deflectors with straightened flutes. Although these deflectors may be used with nozzles described herein for full circle irrigation, it is also contemplated that may be used with other types of nozzles, such as, without limitation, variable arc nozzles, strip nozzles, and any type of rotary nozzle using a rotating deflector.

Figure 28:
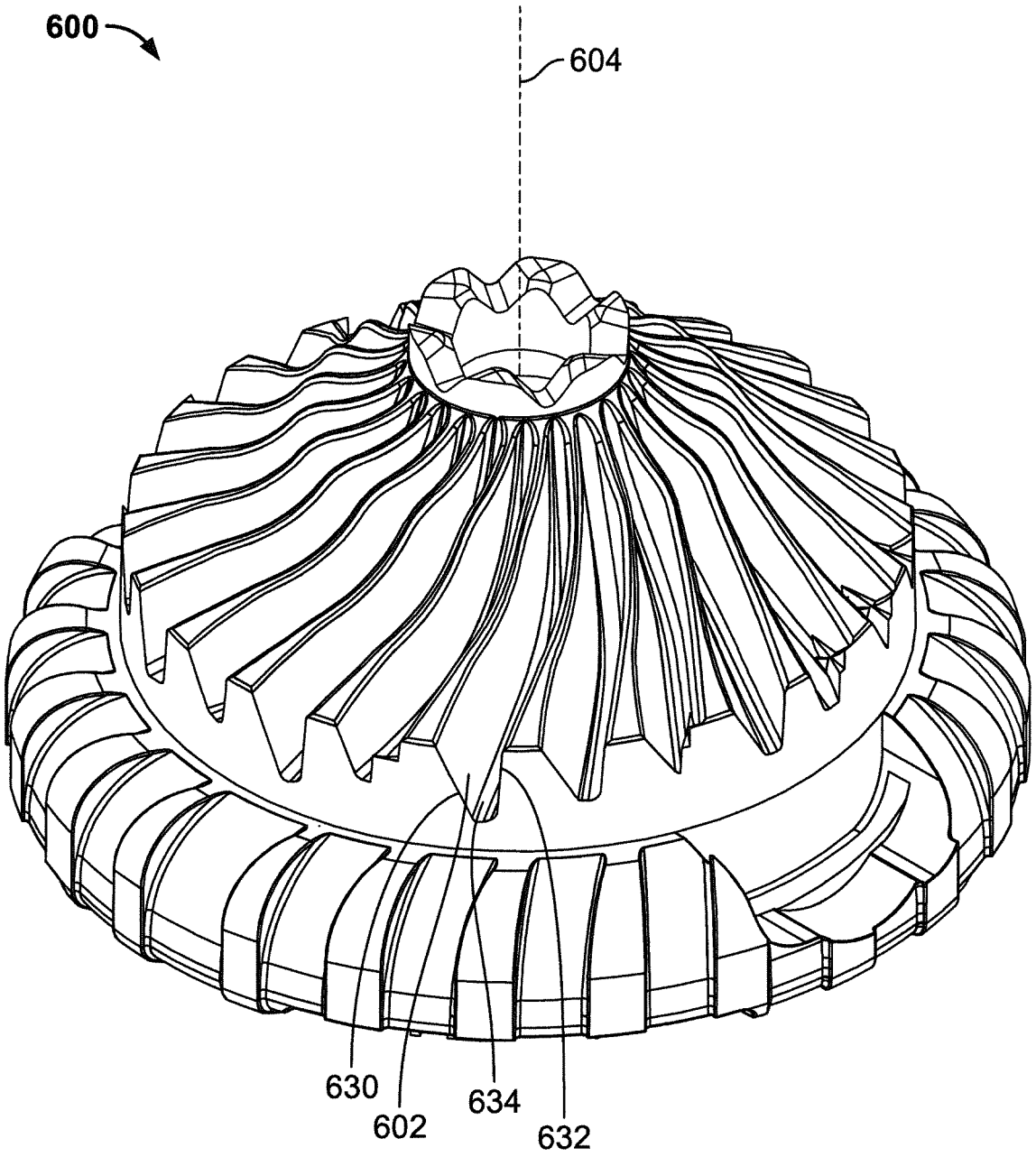
FIG. 28 (Prior Art)
FIG. 28 is a perspective view of a prior art deflector.
Figure 29:
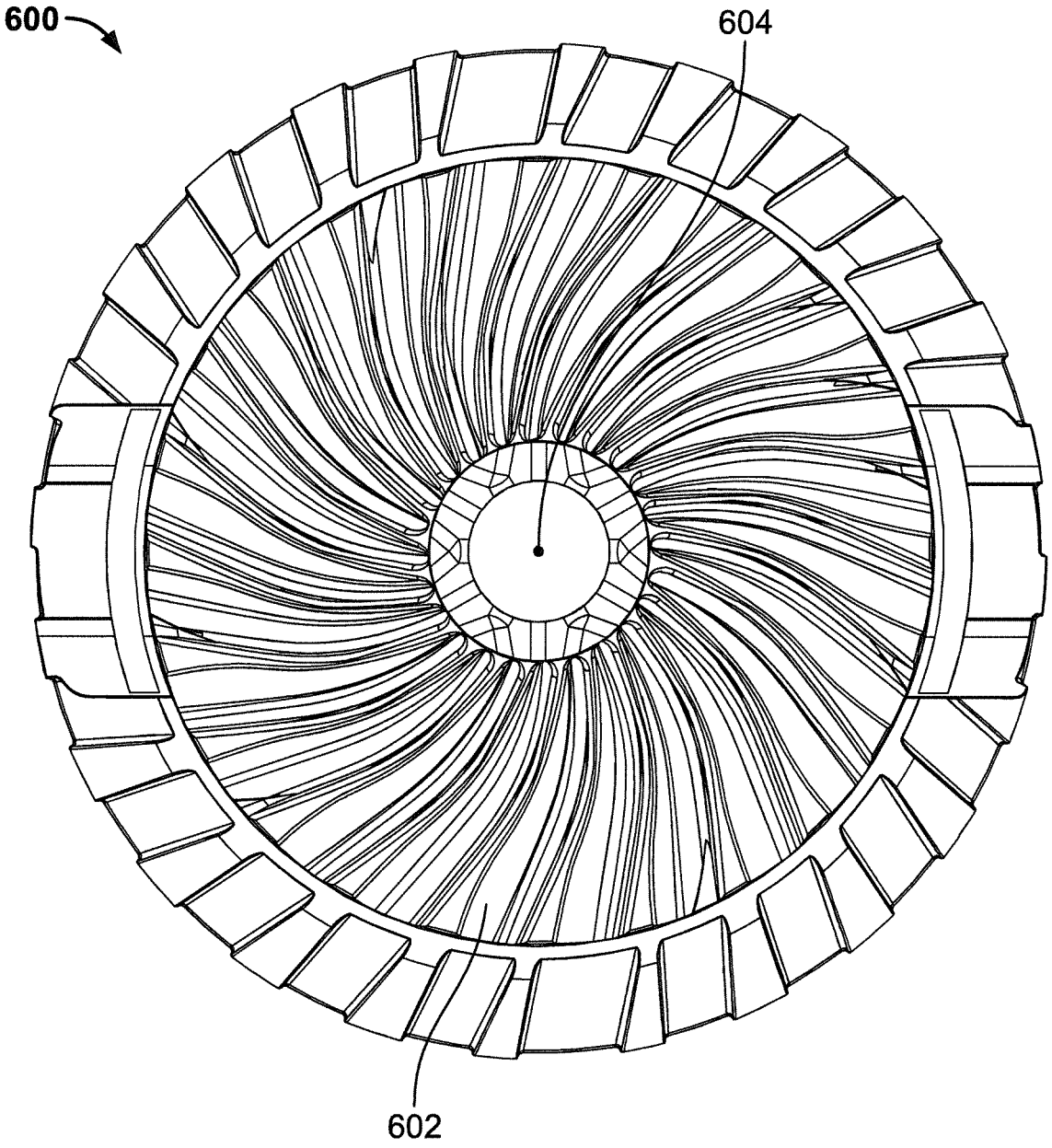
FIG. 29 (Prior Art)
FIG. 29 is a bottom view of the prior art deflector of FIG. 28.
Figure 30:
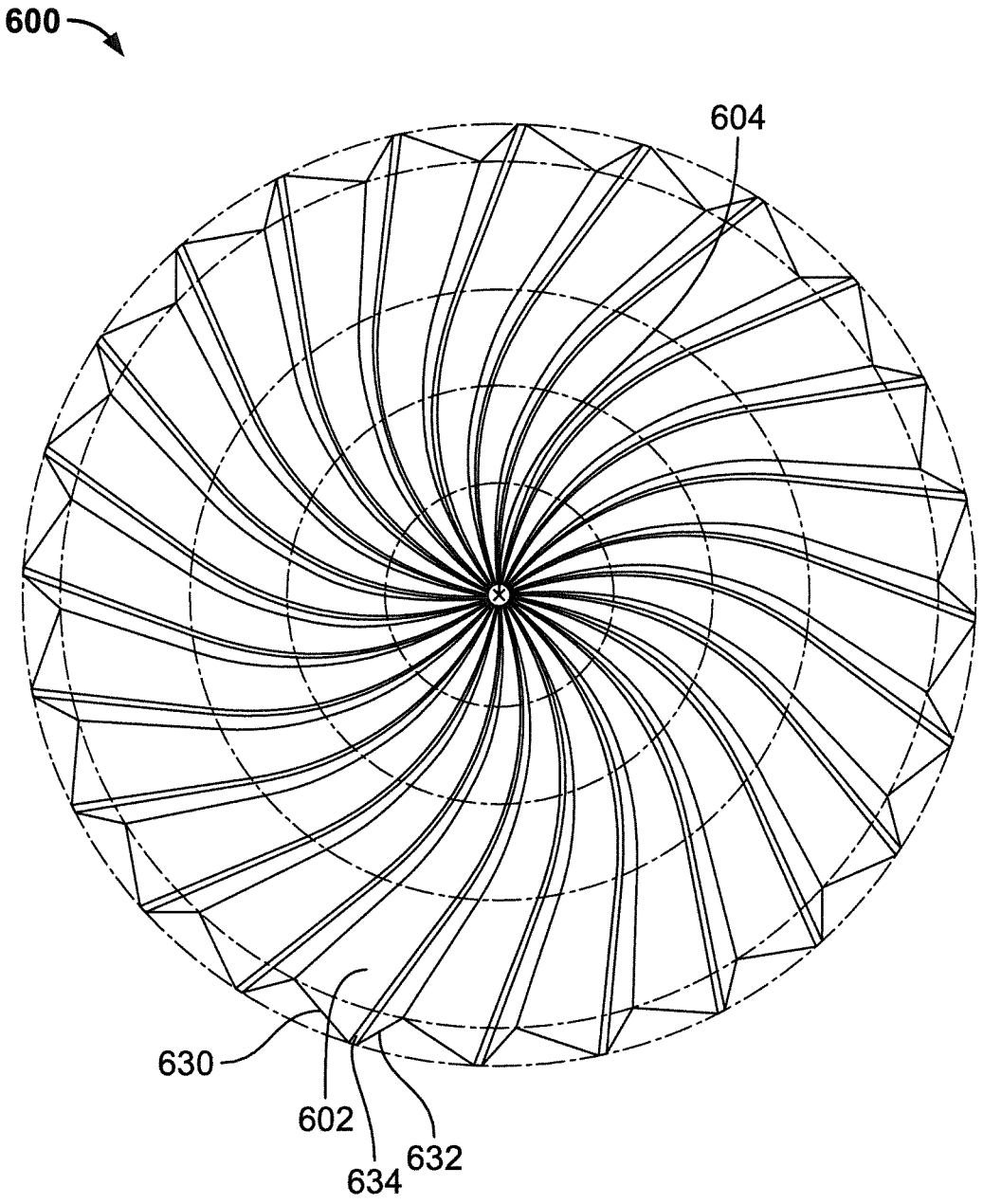
FIG. 30 (Prior Art)
FIG. 30 is a schematic representation of the flute geometry of the prior art deflector of FIG. 28.

FIGS. 28-30 show one form of a prior art deflector 600. As can be seen, each flute 602 generally includes a first sidewall 630 and a second sidewall 632 defining a channel 634 therebetween. FIG. 30 shows a simplified representation of the basic flute geometry of the deflector 600 in which the flutes 602 have been extended inwardly. As can be seen, the flutes 602 each define the same general shape, and if extended inwardly, they will each intersect with and terminate at or about the central axis 604 of the deflector 600. In other words, these flutes 602 are not laterally offset from the central axis 604 of the deflector 600. It has been found generally that these axially intersecting vanes 602 require a certain curvature so as to drive the rotation of the deflector 600, which simultaneously results in a loss of energy in the fluid impacting the deflector 600 and being distributed outwardly from the deflector 600.

Figure 31:
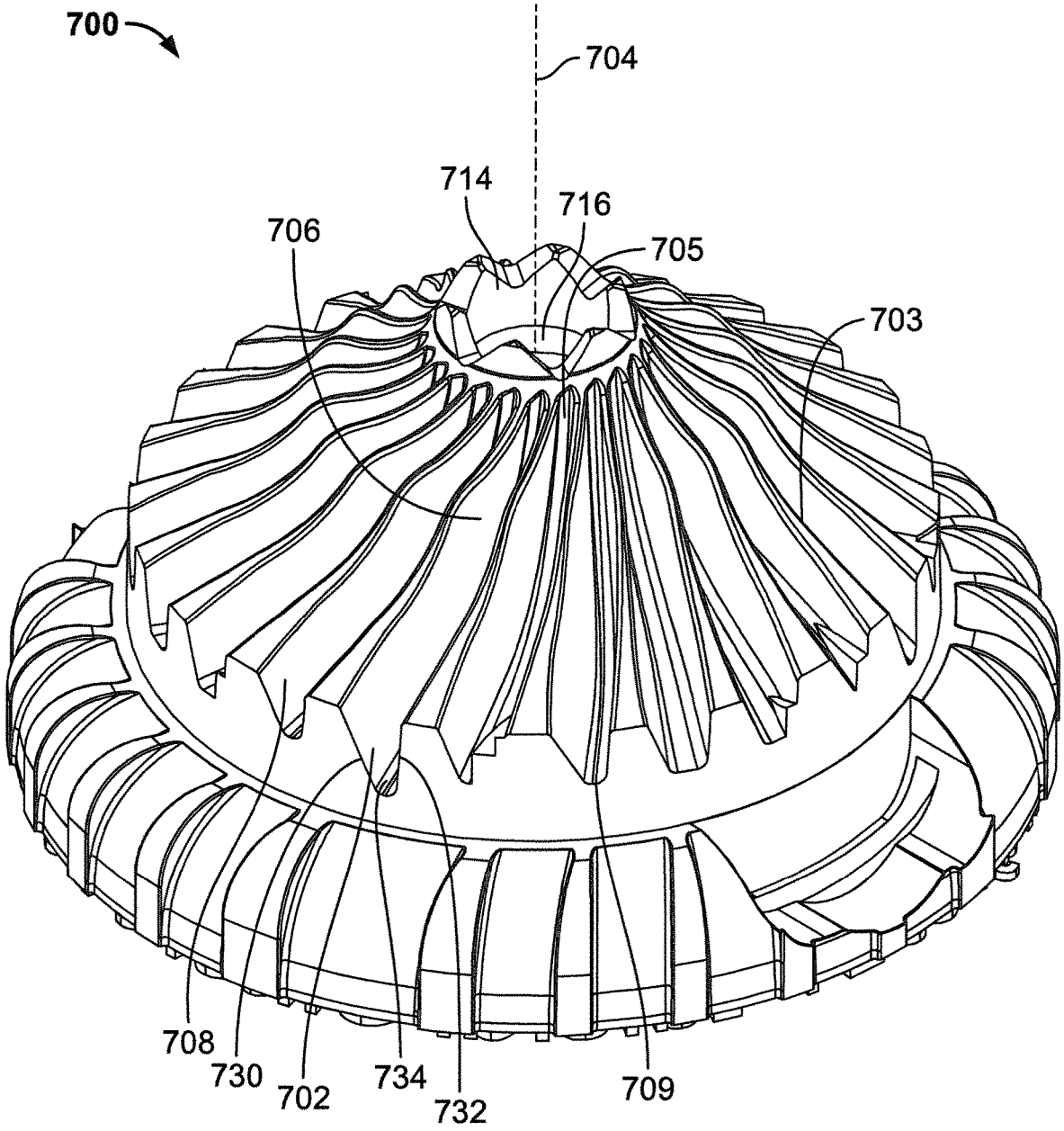
FIG. 31 is a perspective view of a first embodiment of a deflector embodying features of the present invention.
Figure 32:
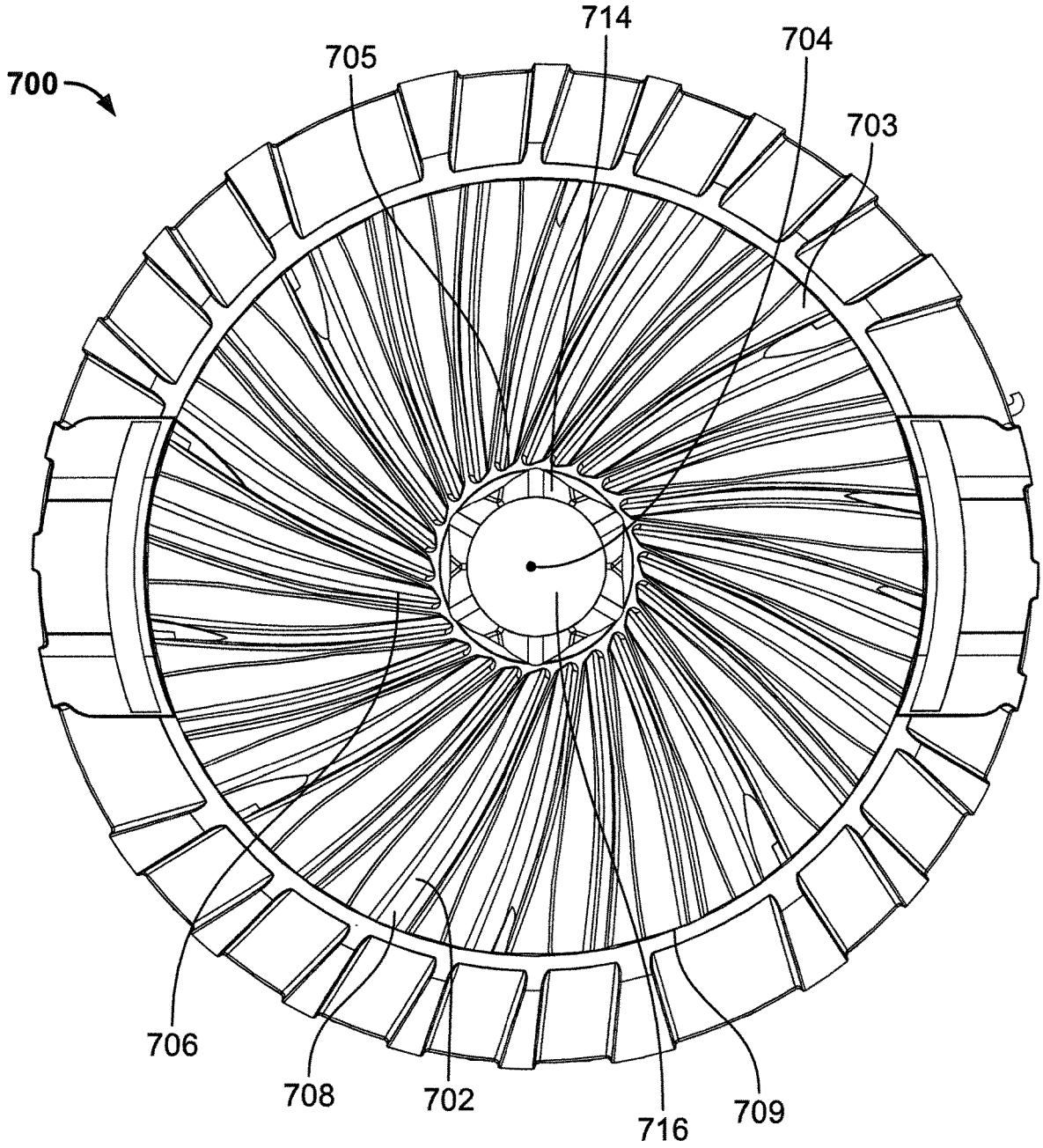
FIG. 32 is a bottom view of the deflector of FIG. 31.
Figure 33:
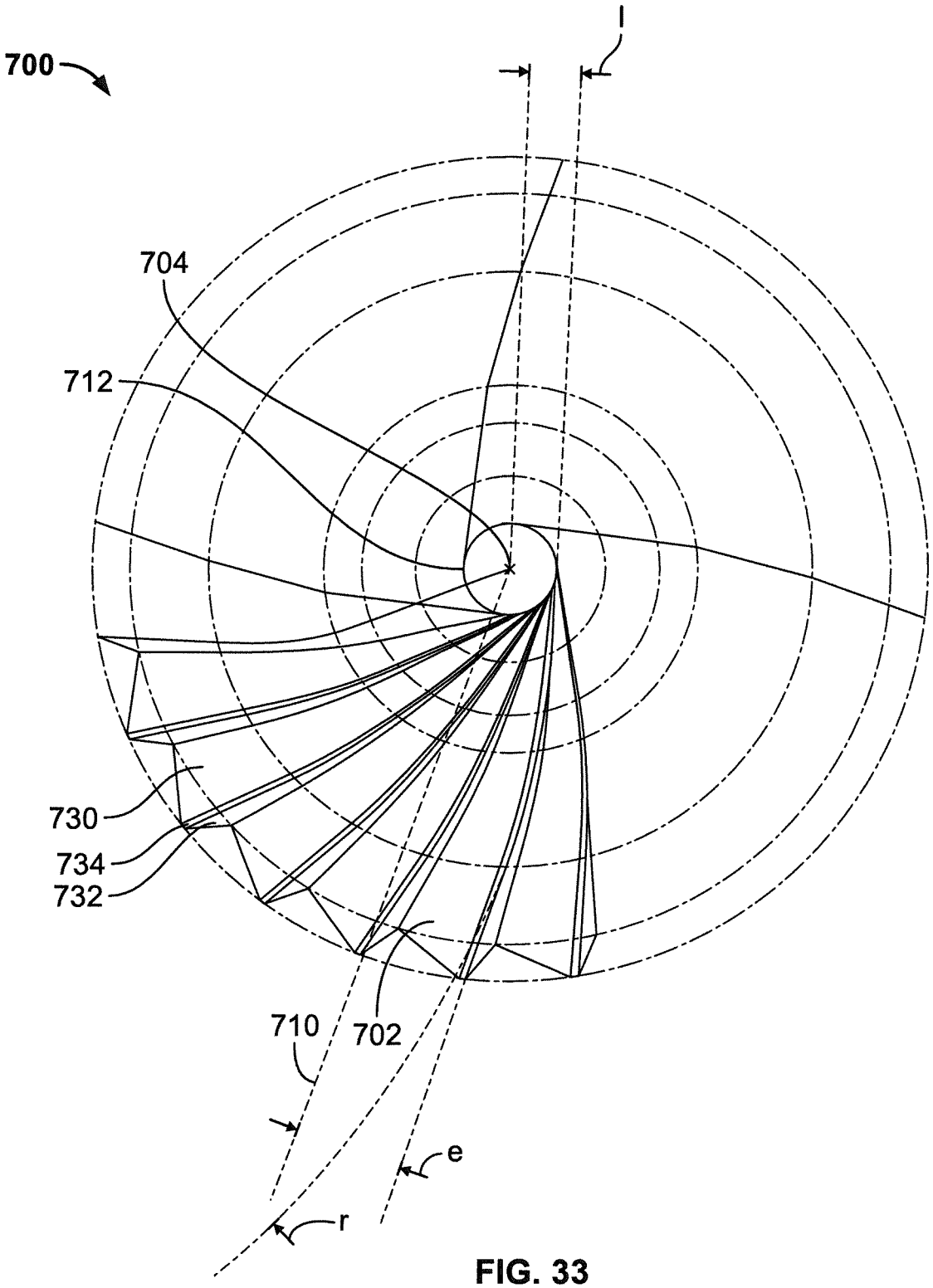
FIG. 33 is a partial schematic representation of the flute geometry of the deflector of FIG. 31.

FIGS. 31-33 show a specialized form of deflector 700 with flutes 702 disposed on the underside surface 703 resulting in a greater throw distance than deflector 600. As can be seen, the flutes 702, if extended inwardly, will not each intersect with and terminate at or about the central axis 704 of the deflector 700. In other words, if the inlet end 705 is arcuately extended inwardly, it does not intersect at or near the central axis 704. These flutes 702 are laterally offset from the central axis 704 of the deflector 700.

FIG. 33 shows a partial representation of the basic flute geometry of the deflector 700 in which the flutes 702 have been extended inwardly. Each flute 702 generally includes a first sidewall 730 and a second sidewall 732 defining a channel 734 between them (the structure of the sidewalls 730 and 732 has been simplified and made more uniform in the representation). The flutes 702 include an inner arcuate portion 706 with a predetermined radius of curvature (r) and an outer linear portion 708 extending to an outlet end 709. However, as can be seen, the flutes 702 are laterally offset such that the inner arcuate portion 706 terminates at a lateral offset distance (l) from the central axis 704. The innermost points of the flutes 702 collectively define a circle 712 with a predetermined radius corresponding to the lateral offset distance (1). Further, if the outer linear portion 708 is extended outwardly and a parallel radial line 710 is drawn outwardly from the central axis 704, an exit offset distance (e) can be determined. As a result of this lateral offset, the flutes 702 may have a greater radius of curvature (less curved) in order to achieve a comparable vane exit offset distance (e), which is desired to drive rotation of the deflector 700. The exit offset distance (e) represents a combination of the lateral offset and the flute curvature, so by providing a lateral offset, the flute curvature can be reduced to achieve an exit offset distance (e) that is comparable to the deflector 600 having no lateral offset plus a flute with greater curvature.

In one example (deflector 700), the lateral offset (l) may be in the range of about 0.05 inches (1.27 mm) and the radius of curvature (r) may be in the range of about 0.80 inches (20.32 mm) resulting in the exit offset distance (e) of about 0.10 inches (2.54 mm). In this particular example, the amount of the exit offset (0.10 inches) (2.54 mm) due to the lateral offset from the central axis (0.05 inches) (1.27 mm) is 50% of the exit offset. As should be evident, the dimensions and proportions may be adjusted such that different proportions of the exit offset (e) are due to the lateral offset (l) and the radius of curvature (r), i.e., different combinations of lateral offset distances and curvature may be selected. The dimensions indicated herein are non-limiting examples only and are provided for illustrative purposes.

As stated, the exit offset distance (e) can be determined by extending the linear portion 708 outwardly and drawing a parallel radial line 710 outwardly from the central axis 704. In one form, for example, this exit offset distance (e) may be generally in the amount of about 0.10 inches (2.54 mm). Again, as should be evident, these laterally offset flutes 702 may have different values for the radius of curvature (r) and the exit offset distance (e). However, it has been found that, by introducing a lateral offset (l), the radius of curvature (r) may be increased in order to achieve a comparable, desired exit offset distance (e). In other words, the flutes 702 can be straighter. As a result, it has been found that the fluid impacting the deflector 700 retains more energy than the fluid impacting the deflector 600, which results in a greater throw distance outwardly from the deflector 700. As should be evident, the values provided are only examples, and many combinations of lateral offset distance (1), exit offset distance (e), and radius of curvature (r) may be selected.

So, in this form, as stated, the flutes 702 (when extended inwardly) do not originate from the central axis 704, or centerline, of the deflector 700 but instead originate at or closer to the central hub 714. In this form, the central hub 714 defines a bore 716 for receiving a shaft that supports the deflector 700. It has been found that this flute arrangement generates torque near the center of the deflector 700 and may use straighter flutes 702 that result in a greater throw distance. In this particular form, there are 24 flutes 702 spaced evenly from adjacent flutes 702 such that adjacent flutes 702 define about 15 degrees of arc, i.e., the flutes 702 are spaced in an equiangular manner. This deflector 700 (and the deflectors described below) may be used with the full circle nozzles described above (and with other types of irrigation nozzles) to generally increase the nominal throw distance of those nozzles. These greater throw distances may help provide a uniform irrigation coverage when using multiple overlapping nozzles to collectively cover an irrigation area and may allow the use of fewer nozzles to cover that area.

Figure 34:
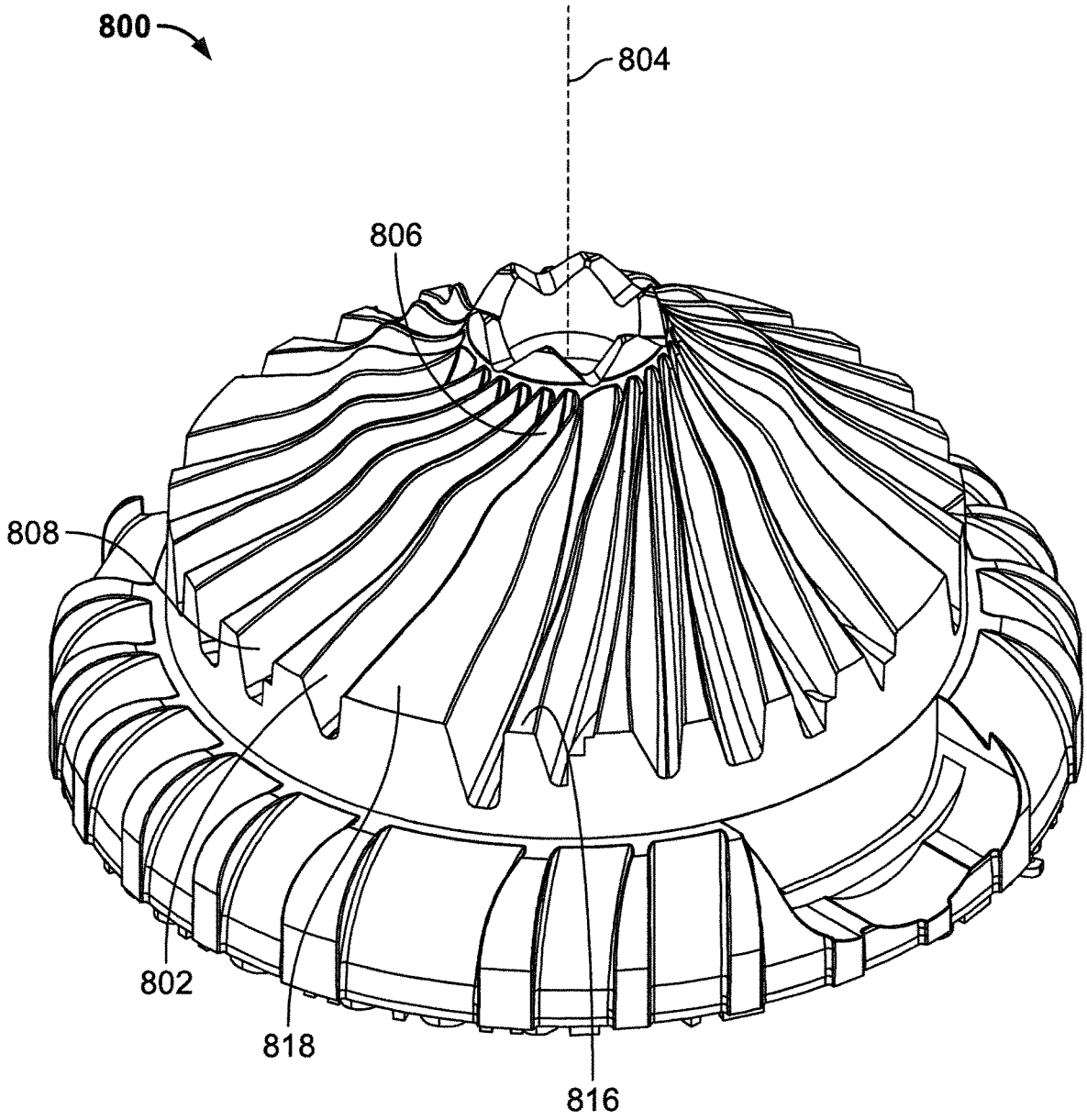
FIG. 34 is a perspective view of a second embodiment of a deflector embodying features of the present invention.
Figure 35:
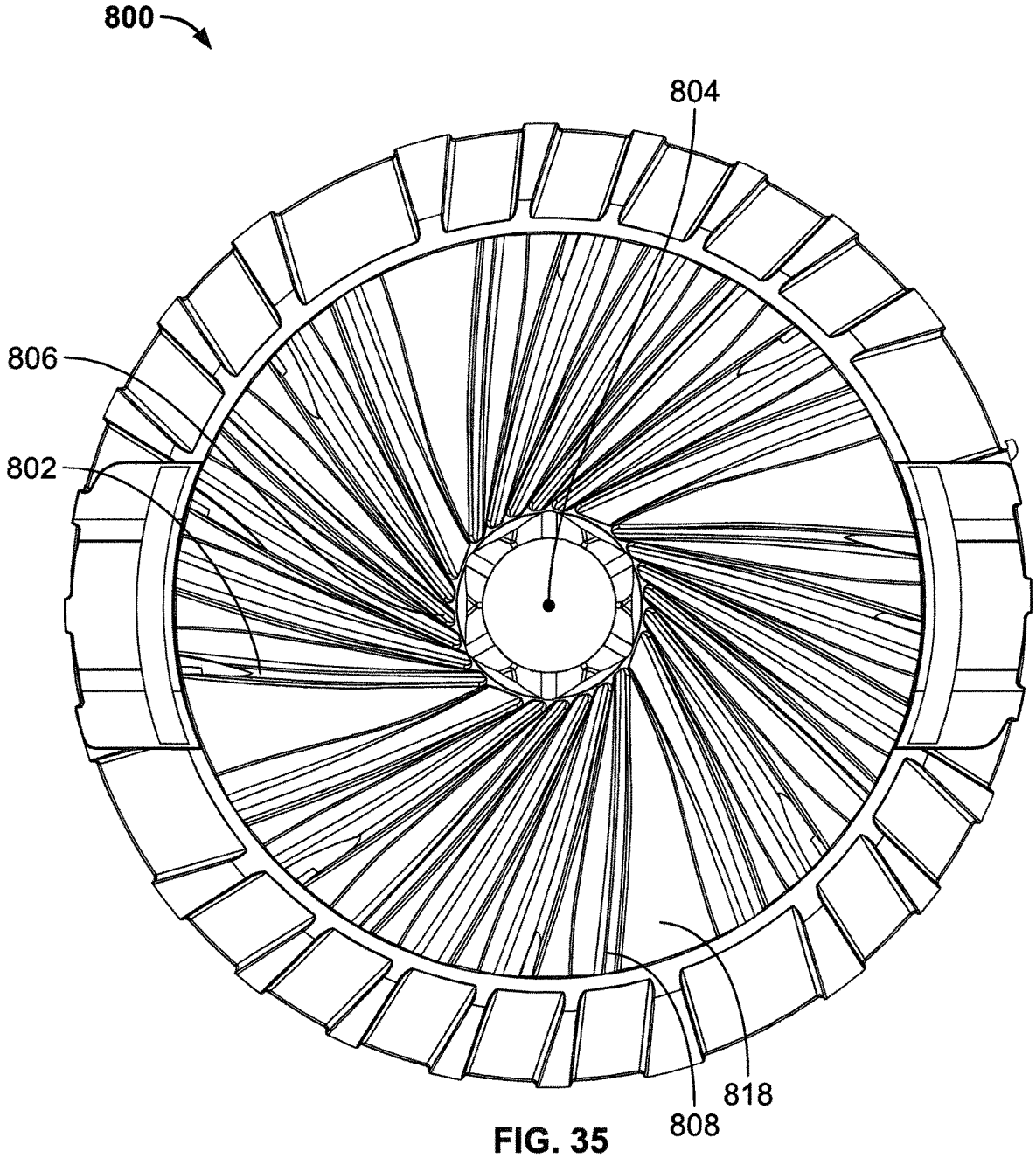
FIG. 35 is a bottom view of the deflector of FIG. 34.

FIGS. 34 and 35 show another form of deflector 800 with laterally offset flutes 802. The flutes 802 again include an inner arcuate portion 806 and an outer linear portion 808. The flutes 802 are laterally offset such that the inner arcuate portion 806 terminates at a lateral offset distance from the central axis 804. In this particular example, the lateral offset may be in the range of about 0.08 inches (2.03 mm) and the radius of curvature may be in the range of about 1.90 inches (48.26 mm) resulting in the exit offset distance of about 0.10 inches (2.54 mm) (the same exit offset distance as for deflector 700). In this particular example, the amount of the exit offset (0.10 inches) (2.54 mm) due to the lateral offset from the central axis (0.08 inches) (2.03 mm) is 80% of the exit offset. In other words, the flutes 802 of deflector 800 are laterally offset more and are straighter than the flutes 702 of deflector 700. As should be evident, the dimensions indicated herein are non-limiting examples only and are provided for illustrative purposes.

As can be seen in the figures, in this particular form, the arrangement of the flutes 802 on the deflector 802 is such that they are not all spaced evenly from adjacent flutes 802. In this example, the deflector 800 includes four sets of six flutes 802 (resulting in a total of 24 flutes 802), and the angular extent defined by each set of flutes 802 is 90 degrees. In this particular form, the angular extent of each of five flutes 802 of each set (and adjacent rib 816) is about 13 degrees such that the sixth flute 802 of each set (and its adjacent rib 818) is about 25 degrees, i.e., the flutes 802 are not all equiangular. As can be seen in the figures, rib 818 is larger than the other ribs 816. As should be evident, the number and size of the flutes 802 may be modified as desired to modify the distribution and throw characteristics of the nozzle.

Figure 36:
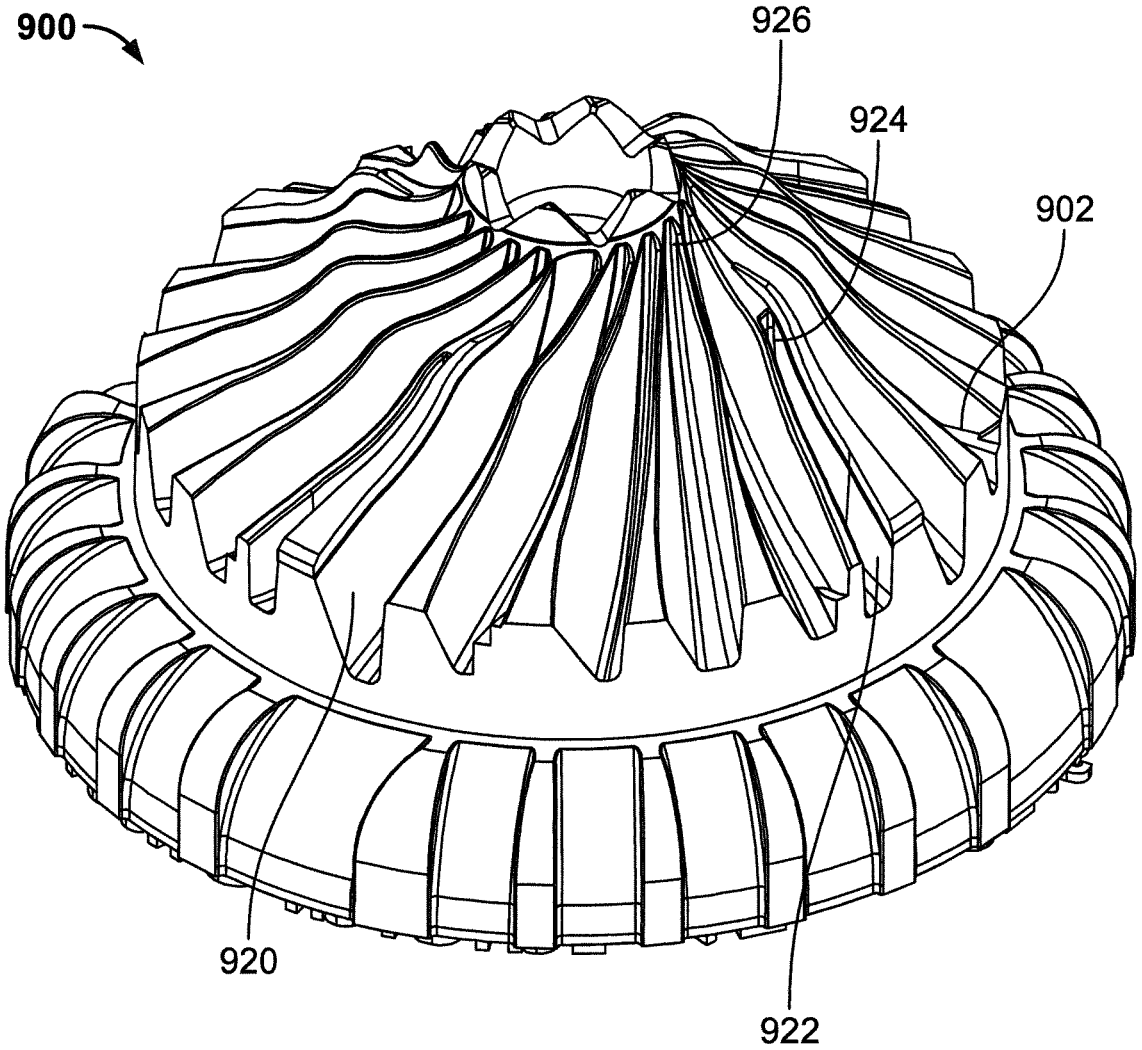
FIG. 36 is a perspective view of a third embodiment of a deflector embodying features of the present invention.
Figure 37:
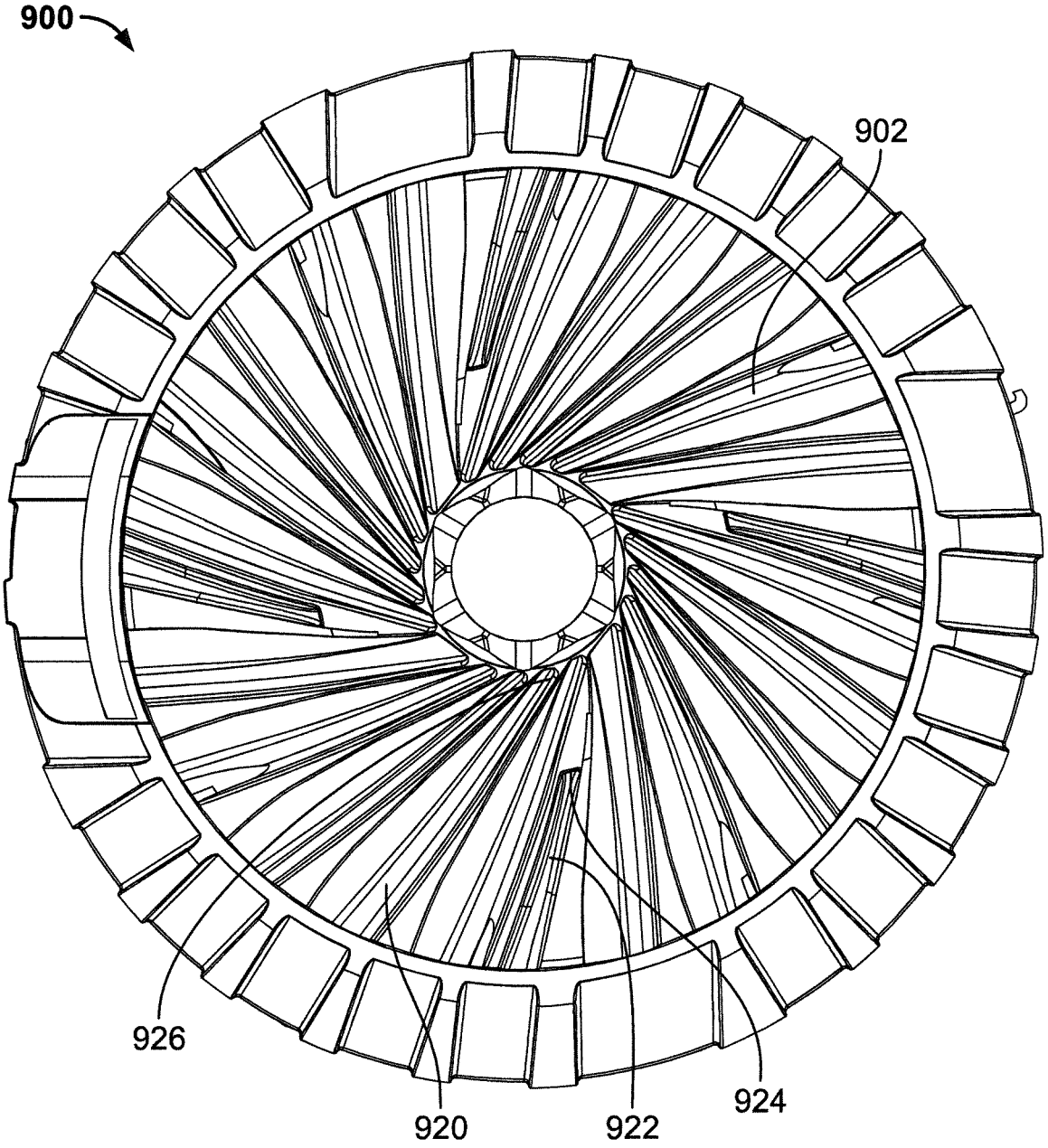
FIG. 37 is a bottom view of the deflector of FIG. 36.

FIGS. 36 and 37 show another form of deflector 900 with laterally offset flutes 902 that is a modified form of deflector 800. In this particular form (like deflector 800), the lateral offset may still be in the range of about 0.08 inches (2.03 mm) and the radius of curvature may be in the range of about 1.90 inches (48.26 mm) resulting in the exit offset distance of about 0.10 inches (2.54 mm). Again, the amount of the exit offset (0.10 inches) (2.54 mm) due to the lateral offset from the central axis (0.08 inches) (2.03 mm) is 80% of the exit offset. In other words, the shape and curvature of flutes 902 is similar to that of flutes 802 of deflector 800.

However, in this particular form, the arrangement of the flutes 902 has been modified. In this example, the deflector 900 includes four sets of five large flutes 920 (resulting in a total of 20 large flutes 920). In this particular form, a sixth smaller flute 922 has been added to each set. This sixth smaller flute 922 has an inlet end 924 that is more radially distant than the inlet ends 926 of the large flute 920. In each set of six flutes, the depth of the flutes may be configured such that there is one flute for a longer throw distance (deeper flute), four flutes for an intermediate throw distance, and a small flute for short distance. As should be evident, the above dimensions and the number and size of the flutes are intended as non-limiting examples.

It will be understood that various changes in the details, materials, and arrangements of parts and components which have been herein described and illustrated in order to explain the nature of the nozzle may be made by those skilled in the art within the principle and scope of the nozzle as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a deflector having an upstream surface contoured to deliver fluid radially outwardly therefrom to a coverage area;

a flow restrictable inlet defining a first set of flow passages and a bore therethrough;

a first body and a second body downstream of the flow restrictable inlet and upstream of the deflector, the first body and the second body defining at least one flow path terminating at an annular exit orifice with the first body defining an inner radius of the annular exit orifice and the second body defining an outer radius of the annular exit orifice;

wherein the annular exit orifice directs fluid against the deflector and defines a full circle coverage area;

wherein the flow restrictable inlet further comprises a solid annular body extending about the bore and extending from the bore to a perimeter, the solid annular body defining the first set of flow passages about the perimeter;

wherein the first set of flow passages are annularly arranged about the perimeter of the flow restrictable inlet to collectively define an annular flow path through the flow restrictable inlet, the flow passages being circumferentially spaced from one another and defining a solid portion between adjacent flow passages, each solid portion having an innermost circumferential dimension different than an outermost circumferential dimension, and the flow passages being fixed against rotation.

2. The nozzle of claim 1, wherein at least a portion of the first body is nested within a recess of the second body.

3. The nozzle of claim 1, wherein the second body defines a second set of flow passages, each flow passage tapering in an upstream direction along at least a portion of the flow passage.

4. The nozzle of claim 3, wherein each flow passage of the second set of flow passages tapers along an upstream distal portion of each flow passage from the annular exit orifice.

5. The nozzle of claim 1, wherein the first body comprises an upstream portion defining a first outer radius and a downstream portion defining a second outer radius, the second outer radius being greater than the first outer radius.

6. The nozzle of claim 1, wherein the first body further comprises a plurality of annularly arranged ribs about a central cylindrical hub defining a plurality of flow channels, fluid flowing to the annular exit orifice through the plurality of flow channels.

7. The nozzle of claim 6, wherein the second body defines a scalloped outer radius at the annular exit orifice with a predetermined number of scallops.

8. The nozzle of claim 7, wherein the first body includes a predetermined number of ribs equal to the predetermined number of scallops on the second body, each rib defining a centerline that is aligned with a centerline of one of the scallops.

9. The nozzle of claim 8, wherein one of the first and second bodies includes a protrusion configured to be received within a recess of the other of the first and second bodies to fix the first and second bodies relative to one another.

10. The nozzle of claim 1, further comprising a shaft supporting the deflector, the shaft passing through the flow restrictable inlet, the first body, and the second body.

11. The nozzle of claim 10, further comprising a spring coupled to the shaft and biasing the shaft against the first body, the shaft urging the first body against the second body.

12. The nozzle of claim 1, wherein the deflector comprises a first set of teeth and the first body comprises a second set of teeth, the first and second sets of teeth configured to engage one another to rotate the first body.

13. The nozzle of claim 1, wherein the first body and second body are configured to direct fluid through the annular exit orifice to impact the deflector and radially outwardly a predetermined maximum distance from the deflector.

14. The nozzle of claim 13, further comprising a radius adjustment valve downstream of the flow restrictable inlet and upstream of the first body and the second body, the radius adjustment valve configured to reduce the throw radius of the deflector below the predetermined maximum distance.

15. The nozzle of claim 14, wherein the radius adjustment valve comprises a valve body configured for movement toward and away from the flow restrictable inlet.

16. The nozzle of claim 1, wherein the second body and the inlet each include complementary gripping surfaces so that the inlet is locked against rotation.

17. A nozzle comprising:

a deflector having an upstream surface contoured to deliver fluid radially outwardly therefrom to a coverage area;

a flow restrictable inlet defining a first set of flow passages therethrough;

a radius adjustment valve disposed downstream of the flow restrictable inlet and upstream of the deflector, the radius adjustment valve being adjustable to increase or decrease flow through the valve;

a first body and a second body disposed downstream of the radius adjustment valve and upstream of the deflector, the first body and the second body together defining an annular exit orifice and the second body defining a second set of flow passages therethrough, the second set of flow passages defining sweeping flow paths through the second body;

wherein the annular exit orifice directs fluid against the upstream surface of the deflector, the deflector redirecting the fluid radially outwardly from the deflector to define a full circle coverage area;

wherein the first body defines a smoothly curved outer wall with an uninterrupted sweeping surface;

wherein a terminal portion of the second body defines a smoothly curved inner wall with a sweeping surface uninterrupted by an annular edge or an annular crease, the smoothly curved inner wall being spaced from the smoothly curved outer wall;

wherein the smoothly curved outer wall and smoothly curved inner wall define an exit flow passage at the annular exit orifice;

wherein the first body and second body are permanently fixed against all rotation relative to one another in both clockwise and counterclockwise directions at the same time.

18. The nozzle of claim 17, wherein the first set of flow passages are annularly arranged about the flow restrictable inlet to collectively define an annular flow path through the flow restrictable inlet.

19. The nozzle of claim 17, wherein the first body defines an inner radius of the annular exit orifice and the second body defines an outer radius of the annular exit orifice.

20. The nozzle of claim 17, wherein each flow passage of the second set of flow passages tapers in an upstream direction along a distal upstream portion of each flow passage relative to the annular exit orifice.

21. The nozzle of claim 17, wherein the radius adjustment valve comprises a valve body configured for movement toward and away from the flow restrictable inlet.

22. The nozzle of claim 19, wherein the first body further comprises a plurality of circumferentially spaced ribs about a central cylindrical hub defining a plurality of flow channels and wherein the second body defines a scalloped outer radius at the annular exit orifice.

23. A nozzle comprising:

a deflector having an upstream surface contoured to deliver fluid radially outwardly therefrom to a coverage area, the deflector including a first set of teeth;

a first body and a second body upstream of the deflector, the first body and the second body defining at least one flow path terminating at an annular exit orifice with the first body defining an inner radius of the annular exit orifice and the second body defining an outer radius of the annular exit orifice;

wherein the annular exit orifice directs fluid against the deflector and defines a full circle coverage area;

wherein the first body includes a second set of teeth on a downstream surface and configured for engagement with the first set of teeth of the deflector;

wherein the first body includes a third set of teeth projecting from a terminal upstream end and the second body includes a fourth set of teeth configured for engagement with the third set of teeth, the engagement of the third set of teeth with the fourth set of teeth enabling rotation of the first body with the second body;

wherein rotation of the deflector causes rotation of the nozzle through engagement of the first, second, third, and fourth sets of teeth.

24. The nozzle of claim 1, further comprising:

a nozzle collar upstream of the deflector and including a cylindrical wall, the nozzle collar configured for actuation by a user to adjust the flow of fluid through the nozzle;

wherein the flow restrictable inlet is in the form of a first insert mounted to the cylindrical wall of the nozzle collar, the first insert being selected from a plurality of inserts, the first insert including an upstream end defining the first set of flow passages with each flow passage having a first cross-sectional area.

25. The nozzle of claim 24, further comprising:

a second insert configured for mounting to the cylindrical wall of the nozzle collar, the second insert including an upstream end defining an alternate set of flow passages with each flow passage having a second cross-sectional area, the second insert defining a bore therethrough.

* * * * *